US007509939B2

(12) United States Patent
Asano et al.

(10) Patent No.: US 7,509,939 B2
(45) Date of Patent: Mar. 31, 2009

(54) THROTTLE CONTROL APPARATUS FOR INTERNAL COMBUSTION ENGINE

(75) Inventors: Hideki Asano, Obu (JP); Katsumi Ishida, Obu (JP); Tsutomu Miyazaki, Aichi-ken (JP); Kazuhiro Minamitani, Toyota (JP); Shigeru Kamio, Nagoya (JP); Akihiro Kamiya, Takahama (JP)

(73) Assignees: Aisan Kogyo Kabushiki Kaisha, Obu-shi (JP); Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 0 days.

(21) Appl. No.: 11/705,514

(22) Filed: Feb. 13, 2007

(65) Prior Publication Data

US 2007/0186900 A1 Aug. 16, 2007

(30) Foreign Application Priority Data

Feb. 14, 2006 (JP) ..... 2006-036035

(51) Int. Cl.
*F02D 11/10* (2006.01)

(52) U.S. Cl. ..... 123/399

(58) Field of Classification Search ..... 123/361, 123/396, 399

See application file for complete search history.

(56) References Cited

U.S. PATENT DOCUMENTS

| | | | | |
|---|---|---|---|---|
| 5,078,110 | A * | 1/1992 | Rodefeld | 123/399 |
| 6,431,144 | B1 * | 8/2002 | Daly | 123/399 |
| 7,100,570 | B2 | 9/2006 | Miyazaki | |
| 7,434,565 | B2 * | 10/2008 | Miyachi | 123/399 |
| 2005/0155574 | A1 * | 7/2005 | Hedrick et al. | 123/399 |
| 2006/0213483 | A1 | 9/2006 | Miyachi | |
| 2007/0017482 | A1 | 1/2007 | Nakashima et al. | |

FOREIGN PATENT DOCUMENTS

| | | | |
|---|---|---|---|
| JP | A 59-188050 | | 10/1984 |
| JP | B2 04-004452 | | 1/1992 |
| JP | 10-176548 | * | 6/1998 |
| JP | A 2000-320348 | | 11/2000 |
| JP | A-2003-262178 | | 9/2003 |
| JP | A-2005-042682 | | 2/2005 |
| JP | B2-3632509 | | 3/2005 |
| JP | A-2005-325741 | | 11/2005 |
| JP | A-2005-325751 | | 11/2005 |
| JP | A-2005-325753 | | 11/2005 |
| JP | A-2006-249952 | | 9/2006 |
| JP | A-2007-023933 | | 2/2007 |

* cited by examiner

*Primary Examiner*—Hai H Huynh
(74) *Attorney, Agent, or Firm*—Oliff & Berridge, PLC

(57) ABSTRACT

A throttle control apparatus comprises a throttle valve placed in an intake passage, a motor for driving the throttle valve, an electronic control unit (ECU) for controlling the motor, and a throttle sensor for detecting an actual opening degree of the throttle valve. The ECU determines that the throttle valve is frozen when the actual opening degree does not reach a target opening degree even after a driving time for driving the motor has exceeded a predetermined time, and then stores the actual opening degree at the time as an icing opening degree. The ECU supplies a driving duty to cause the motor to produce required driving torque for removal of icing and reverses the driving duty by open control, and controls the motor to bring an accumulated value of a deviation between the target opening degree and the icing opening degree to zero, thereby repeatedly swinging the throttle valve.

49 Claims, 18 Drawing Sheets

《MOTOR CHARACTERISTICS》

《OPENING-DEG. VS. FLOW-RATE CHARACTERISTICS》

THROTTLE CONTROL APPARATUS FOR INTERNAL COMBUSTION ENGINE

BACKGROUND OF THE INVENTION

1. Field of the Invention

The present invention relates to a throttle control apparatus for an internal combustion engine adapted to drive a throttle valve placed in an intake passage of the internal combustion engine by using a driving device to cope with icing of the throttle valve.

2. Description of Related Art

As this type of apparatus, there is conventionally known for example a throttle control apparatus disclosed in Japanese examined patent publication No. 4(1992)-4452. This throttle control apparatus is arranged to control a throttle valve for preventing icing or freezing thereof in a cold environment. The icing of the throttle valve indicates the phenomenon in which vapor and fuel contained in intake air freeze to form ice on or around the throttle valve when the intake air is low in temperature and high in humidity during engine warm-up condition, thus causing blockage of an intake passage. In some cases, further, the icing may cause the engine to stop. For avoiding such troubles, the above throttle control apparatus comprises operating condition detection means for detecting an engine operating condition, icing detection means for detecting whether the throttle valve is in a frozen or iced state, throttle valve opening/closing means for electrically opening and closing the throttle valve, and a control circuit for controlling the throttle valve opening/closing means. In this apparatus, an accelerator opening sensor is used as the operating condition detection means and a temperature sensor and a humidity sensor are used as the icing detection means. The throttle valve opening/closing means includes a DC servomotor and its drive circuit. The control circuit is arranged to execute "icing elimination control" which comprises driving the DC servomotor and others according to an engine operating condition based on a signal from the accelerator opening sensor, detecting whether the throttle valve is frozen based on a signal from the temperature sensor, the humidity sensor, and others, and, when detects the icing (the frozen state), controlling the DC servomotor and other components to swing the throttle valve at a predetermined cycle in such a small opening range as to be around the opening degree suitable for the current operating condition without causing no variation in an engine rotational speed.

However, in the throttle control apparatus disclosed in the '452 publication, the control circuit neither detects whether the throttle valve is frozen nor executes the icing elimination control unless a specific environmental condition depending on the accelerator opening degree, temperature, and humidity is satisfied. This apparatus therefore could not cope with icing if occurred under any environmental conditions other than the specific environmental condition. Further, the specific environmental condition depending on the accelerator opening degree, temperature, and humidity is merely determined by estimating a condition that icing is likely to occur and also anticipating the occurrence of icing. Accordingly, even when the control circuit determines whether icing has occurred based on the specific environmental condition, there is a possibility that no icing has occurred actually. In other words, it appears that this throttle control apparatus prospectively detects (estimates) whether the icing has occurred based on the specific environmental condition. Thus, this apparatus would be low in accuracy of icing detection. Further, this throttle control apparatus is arranged to merely swing the throttle valve around a certain target opening degree in order to eliminate icing, which could not produce sufficient torque to the throttle valve. It is consequently concerned that this operation of the throttle valve could not generate sufficient icing elimination power to remove solid or hard frozen ice.

SUMMARY OF THE INVENTION

The present invention has been made in view of the above circumstances and has an object to provide a throttle control apparatus for an internal combustion engine, which is capable of reliably detecting icing of a throttle valve irrespective of differences in environmental conditions.

Another object of the present invention is to provide a throttle control apparatus for an internal combustion engine, which is capable of removing solid ice on or around a throttle valve.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a throttle control apparatus for an internal combustion engine comprising: a throttle valve placeable in an intake passage of the internal combustion engine; a driving device which drives the throttle valve; a control device for controlling the driving device; and an icing determination device which determines that the throttle valve is frozen when a driving current that the control device supplies to the driving device to drive the throttle valve has continued at a predetermined value or higher for a predetermined time or more.

According to another aspect, the present invention provides a throttle control apparatus for an internal combustion engine comprising: a throttle valve placeable in an intake passage of the internal combustion engine; a driving device which drives the throttle valve; a control device for controlling the driving device; and an icing determination device which determines that the throttle valve is frozen when a driving duty that the control device supplies to the driving device to drive the throttle valve has continued at a predetermined value or higher for a predetermined time or more.

According to another aspect, the present invention provides a throttle control apparatus for an internal combustion engine comprising: a throttle valve placeable in an intake passage of the internal combustion engine; a driving device which drives the throttle valve; a control device for controlling the driving device; an opening-degree detecting device for detecting an opening degree of the throttle valve; and an icing determination device which determines that the throttle valve is frozen when the detected opening degree does not reach a target opening degree even after a driving time for which the control device controls the driving device to drive the throttle valve has exceeded a predetermined time.

According to another aspect, further, the present invention provides a throttle control apparatus for an internal combustion engine comprising: a throttle valve placeable in an intake passage of the internal combustion engine; a driving device which drives the throttle valve; and a control device for controlling the driving device; wherein the control device causes the driving device to produce required driving torque to eliminate icing of the throttle valve.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

First Embodiment

A detailed description of a first preferred embodiment of a throttle control apparatus of the present invention will now be given referring to the accompanying drawings.

Figure 1:
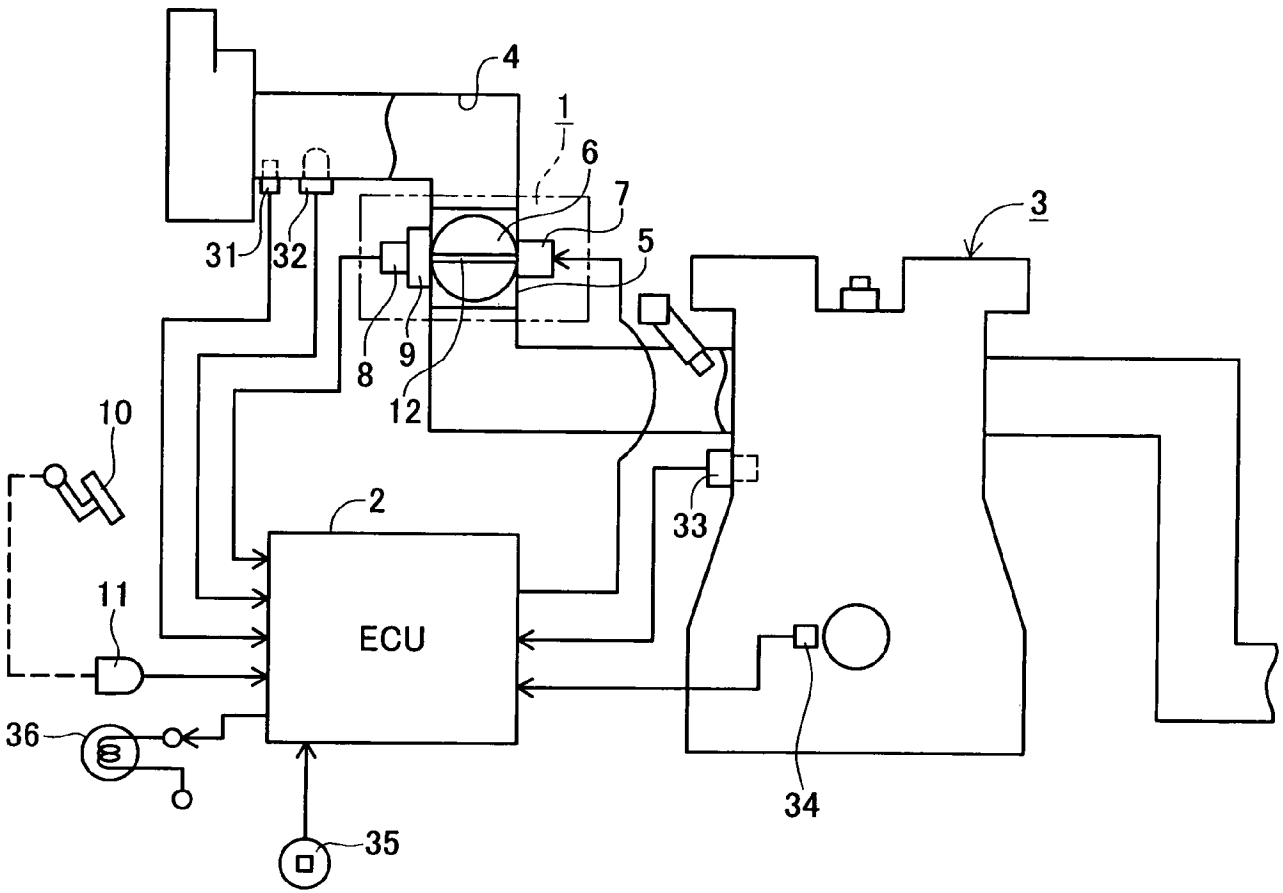
FIG. 1 is a schematic configuration view of a gasoline engine system.

FIG. 1 is a schematic configuration view of a gasoline engine system to be mounted on a vehicle. This gasoline engine system includes the throttle control apparatus of the present invention. The throttle control apparatus is provided with an electronic throttle 1 and an electronic control unit (ECU) 2 which controls the electronic throttle 1. The electronic throttle 1 is placed in a throttle body 5 forming an intake passage 4 in order to control the output power of an engine 3 which corresponds to an internal combustion engine of the present invention. The electronic throttle 1 includes a throttle valve 6, a motor 7 corresponding to a driving device of the present invention for driving the throttle valve 6 to open and close, a throttle sensor 8 for detecting an actual degree of opening (hereinafter, "actual opening degree") TA of the throttle valve 6, and an opener mechanism 9 for holding the throttle valve 6 at an opener opening degree. The throttle valve 6 is a linkless type component that does not mechanically interlock with operation of an accelerator pedal 10 located on a driver side. Specifically, an accelerator sensor 11 detects the amount of operation of the accelerator pedal 10, the ECU 2 controls the motor 7 based on the detected operation amount, and the throttle valve 6 is driven by the driving force of the motor 7 to open and close according to the operation amount of the accelerator pedal 10.

Figure 2:
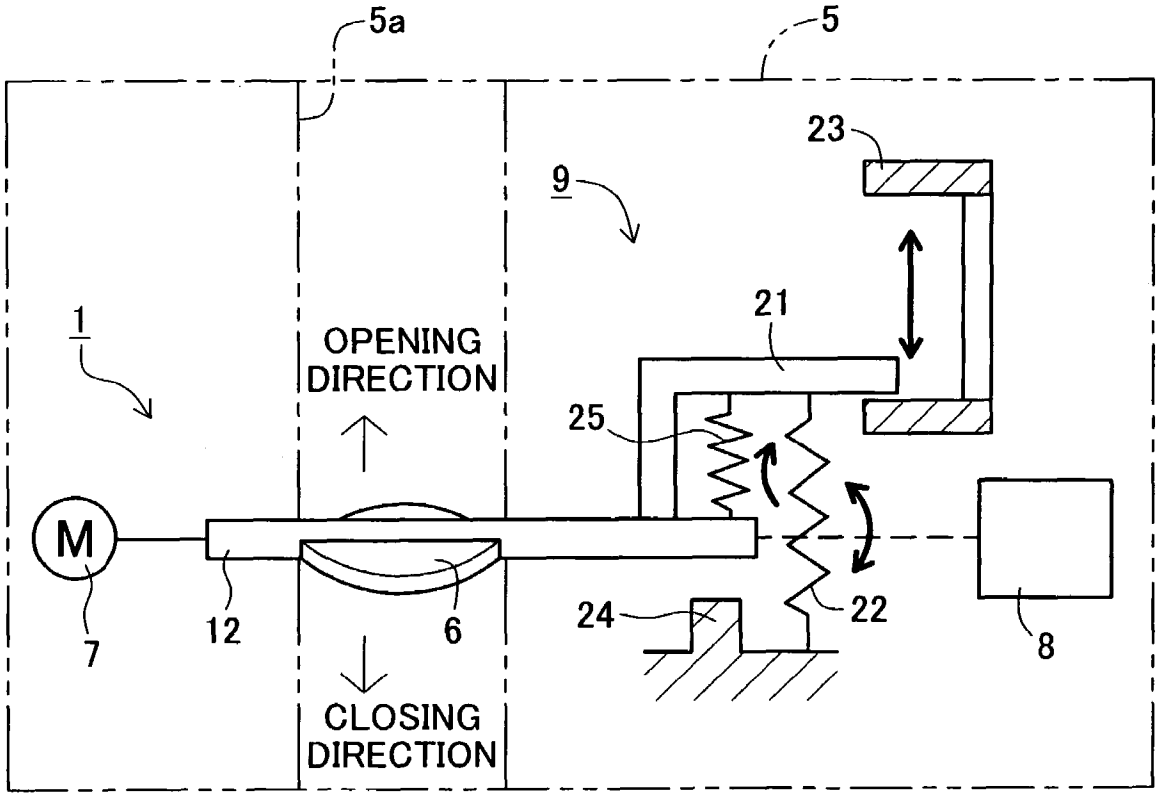
FIG. 2 is a schematic configuration view of an electronic throttle including an opener mechanism.

The throttle valve 6 is rotatably supported in the throttle body 5 with a valve shaft 12 placed across a bore 5*a* of the throttle body 5 (see FIG. 2). An end of the valve shaft 12 is coupled to the motor 7 and the other end of the same is coupled to the throttle sensor 8. This throttle sensor 8 corresponds to an operation detecting device and an opening-degree detecting device of the present invention, and it is composed of for example a potentiometer. The accelerator sensor 11 detects the operation amount of the accelerator pedal 10 operated by a driver to set a detected value as a target degree of opening (hereinafter, referred to as "target opening degree") RA for the throttle valve 6. This sensor 11 is for example composed of a potentiometer.

Figure 3:
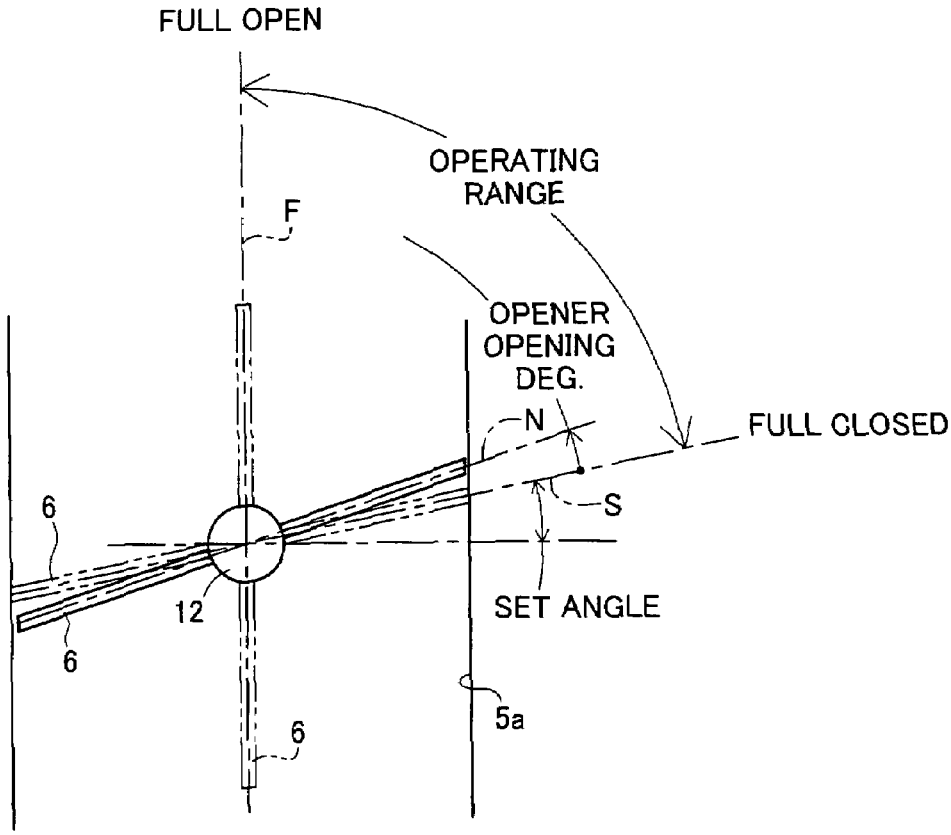
FIG. 3 is an explanatory view showing operations of a throttle valve by the opener mechanism.

The opener mechanism 9 is arranged to hold the throttle valve 6 at an opener degree at which the throttle valve 6 is slightly opened than at a full closed position when the motor 7 is de-energized. FIG. 2 is a schematic configuration view of the electronic throttle 1 including the opener mechanism 9. FIG. 3 is an explanatory view showing the operation of the throttle valve 6 performed by the opener mechanism 9. As shown in FIG. 2, the electronic throttle 1 and the opener mechanism 9 are integrally provided in the throttle body 5. The throttle valve 6 is supported in the throttle body 5 to be rotatable about the valve shaft 12. Ends of the valve shaft 12 are coupled to the motor 7 and the throttle sensor 8 respectively. Regarding the opening and closing of the throttle valve 6, as shown in FIG. 3, it is herein assumed that a rotating direction of the throttle valve 6 from a full closed position S to a full open position F is an "opening direction" and a rotating direction of the same from the full open position F to the full closed position S is a "closing direction".

The opener mechanism 9, referring to FIG. 2, includes an opener lever 21 for holding the throttle valve 6 in a predetermined opener position N (see FIG. 3) during stop of the engine 3, i.e. during de-energization of the motor 7. One end of a return spring 22 is fixed to the opener lever 21 and the other end is fixed to the throttle body 5. The return spring 22 urges the throttle valve 6 in the closing direction through the opener lever 21. The opener lever 21 will be rotated to a predetermined position where it is engaged with a full-open stopper 23 and stopped therein. The throttle body 5 is provided with a full-close stopper 24 for holding the throttle valve 6 in the full closed position S (see FIG. 3). An opener spring 25 is fixed at one end to the opener lever 21 and at the other end to the valve shaft 12. This opener spring 25 urges the throttle valve 6 in the opening direction. In the present embodiment, the opener lever 21, return spring 22, full-open stopper 23, full-close stopper 24, opener spring 25, and others constitute the opener mechanism 9.

The urging force of the return spring 22 is set to be smaller than the driving force of the motor 7 and larger than the detent torque occurring during de-energization of the motor 7. This setting is to cause the throttle valve 6 to open and close against the urging force of the return spring 22 or opener spring 25 during energization of the motor 7, whereas it is to achieve a balance between the return spring 22 and the opener spring 25, thereby holding the throttle valve 6 in a predetermined opener opening position N, during de-energization of the motor 7.

While the motor 7 is in a de-energized state during stop of the engine 3, the opener opening position N shown in FIG. 3 is regarded as an initial opening degree allowing start of the engine 3. While the motor 7 is in the de-energized state during operation of the engine 3, on the other hand, the opener opening position N is regarded as an opening allowing the engine 3 to maintain a power level enough for a vehicle to run to a road shoulder for evacuation. During stop of the engine 3 or during de-energization of the motor 7, the valve shaft 12 and the opener lever 21 are urged in the closing direction by the return spring 22. At the same time, the valve shaft 12 is urged in the opening direction by the opener spring 25. By a balanced relation between those return spring 22 and opener spring 25, the throttle valve 6 is held in the opener opening position N.

When the throttle valve 6 is to be opened from the opener opening position N to the full open position F, the valve shaft 12 is rotated by the driving force of the motor 7 against the urging force of the return spring 22 until the opener lever 21 is engaged with the full-open stopper 23. When the throttle valve 6 is to be closed from the opener opening position N to the full closed position S, the valve shaft 12 is rotated by the driving force of the motor 7 against the urging force of the opener spring 25 until the valve shaft 12 is engaged with the full-close stopper 24.

During operation of the engine 3, the ECU 2 controls the motor 7 according to the operation amount of the accelerator pedal 10 to open the throttle valve 6 at a predetermined degree of opening (herein, referred to as "opening degree"). This opening degree of the throttle valve 6 is determined in an operating range from the full closed position S to the full open position F as shown in FIG. 3 according to the operation amount of the accelerator pedal 10. For the full open position F, the opener lever 21 is engaged with the full-open stopper 23 and therefore the throttle valve 6 is held so that the bore 5*a* is opened at a maximum. With this full-open stopper 23, the throttle valve 6 is prevented from excessively rotating in the opening direction beyond the full open position F. For the full closed position S, on the other hand, the valve shaft 12 is engaged with the full-close stopper 24 and therefore the throttle valve 6 is held so that the bore 5*a* is fully closed. With this full-close stopper 24, the throttle valve 6 is prevented from excessively rotating in the closing direction beyond the full closed position S. When the motor 7 is de-energized, the return spring 22 and the opener spring 25 are brought into the balanced relation as mentioned above, so that the throttle valve 6 is held in the opener opening position N at which the throttle valve 6 is slightly opened than at the full closed position S.

As shown in FIG. 1, connected to the ECU 2 are an intake temperature sensor 31 for detecting an intake temperature THA in the intake passage 4, an airflow meter 32 for detecting an intake-air flow rate QA in the intake passage 4, a water temperature sensor 33 for detecting a cooling water temperature THW in the engine 3, a rotational speed sensor 34 for detecting a rotational speed NE of the engine 3, and an ignition switch 35 which is operated to start/stop the engine 3. The airflow meter 32 corresponds to an intake-air flow rate detecting device of the present invention. The ECU 2 is also connected to an alarm lamp 36 placed on a driver side. The ECU 2 includes, as well known, a central processing unit (CPU), a random access memory (RAM), a read only memory (ROM), and others. The ROM stores control programs related to the engine 3 and the electronic throttle 1. In the present embodiment, particularly, the ECU 2 executes icing elimination control for coping with the icing of the throttle valve 6. The ECU 2 corresponds to a control device, an icing determination device, an opening-degree storage device, a fault processing device, and a prestart icing determination device.

The ECU 2 receives a signal representing an actual opening degree TA outputted from the throttle sensor 8 and a signal representing a target opening degree RA outputted from the accelerator sensor 11. In accordance with a PID control technique, the ECU 2 controls the motor 7 based on the received signals representing the actual opening degree TA and the target opening degree RA. Specifically, the ECU 2 calculates an opening-degree deviation between the target opening degree RA and the actual opening degree TA based on the respective received signals to calculate a control amount of the motor 7 in accordance with a predetermined calculating formula based on the opening-degree deviation. The ECU 2 outputs a control signal (a driving duty DY) depending on the control amount to control the motor 7. By this feedback control of the motor 7, regular control is conducted to bring the actual opening degree TA of the throttle valve 6 to the target opening degree RA.

Figure 4:
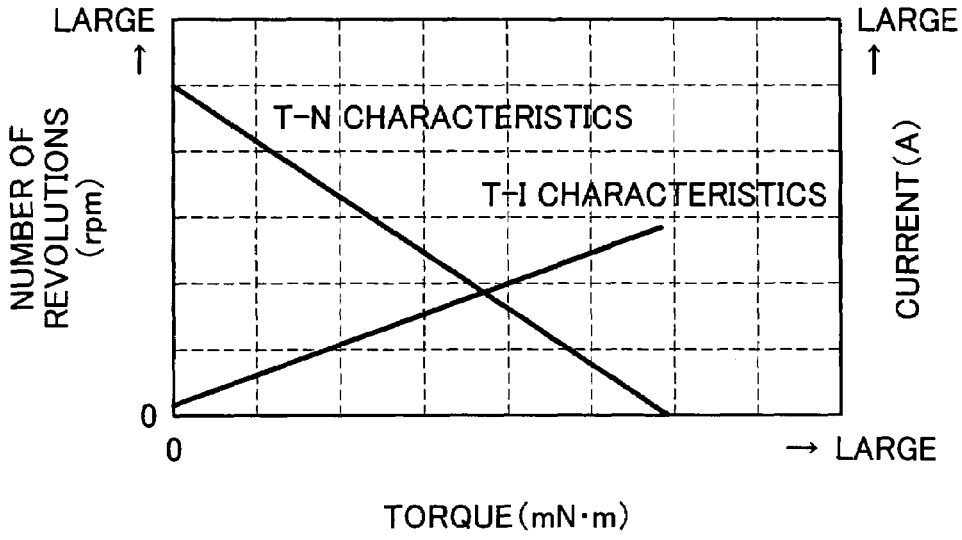
FIG. 4 is a graph showing motor characteristics.
Figure 5:
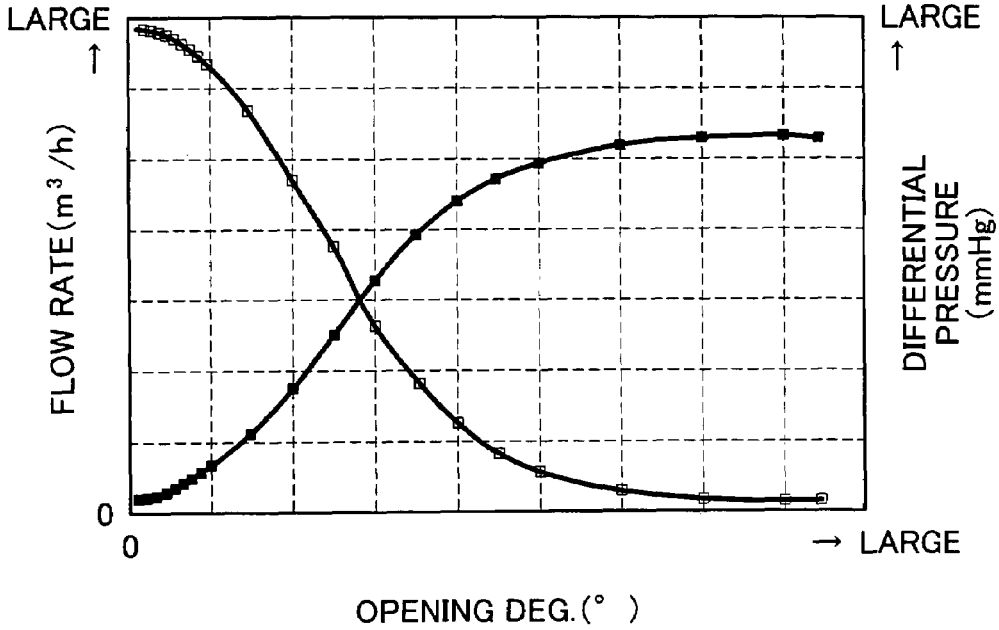
FIG. 5 is a graph showing a relationship between an opening degree and a flow rate (opening-degree vs. flow-rate characteristics) and others.

Herein, FIG. 4 is a graph showing the "motor characteristics" of the motor 7 in the present embodiment and FIG. 5 is a graph showing the "opening-degree vs. flow-rate characteristics" of the throttle valve 6. In the graph of FIG. 4, the horizontal axis indicates the torque of the motor 7 and the right and left vertical axes indicate the number of revolutions of the motor 7 and the current respectively. In this graph, a downward-sloping line represents a relationship between the torque and the number of revolutions (T-N characteristics) and an upward-sloping line represents a relationship between the torque and the current (T-I characteristics). In the graph of FIG. 5, the horizontal axis indicates the opening degree of the throttle valve 6 and the right and left vertical axes indicate the flow rate of intake air and the differential pressure of intake air (a differential pressure between upstream and downstream of the throttle valve) respectively. In this graph, a downward-sloping line represents a relationship between the opening-degree and the differential pressure and an upward-sloping represents a relationship between the opening-degree and the flow rate.

Figure 6:
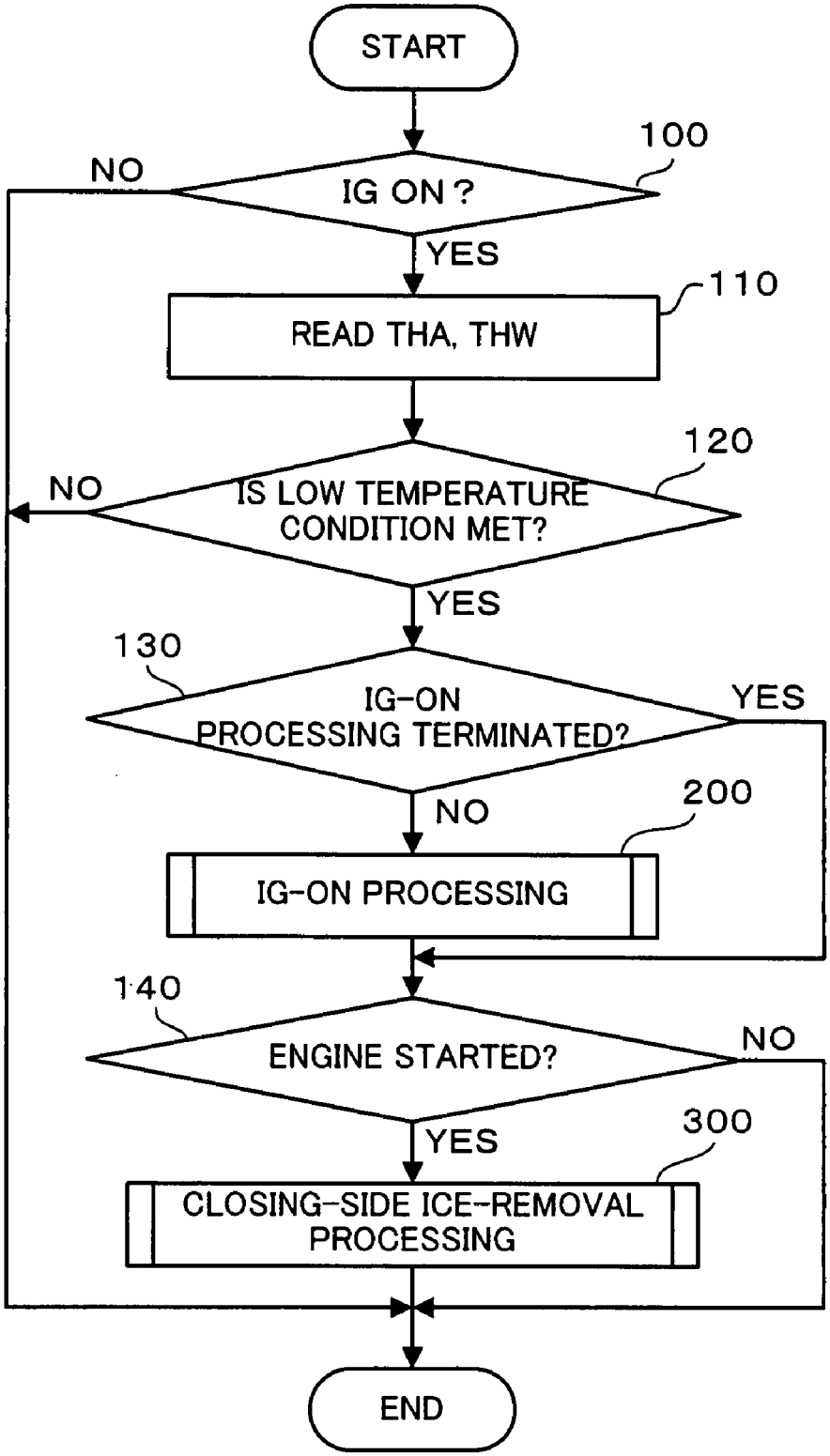
FIG. 6 is a flowchart showing contents of icing elimination control.
Figure 7:
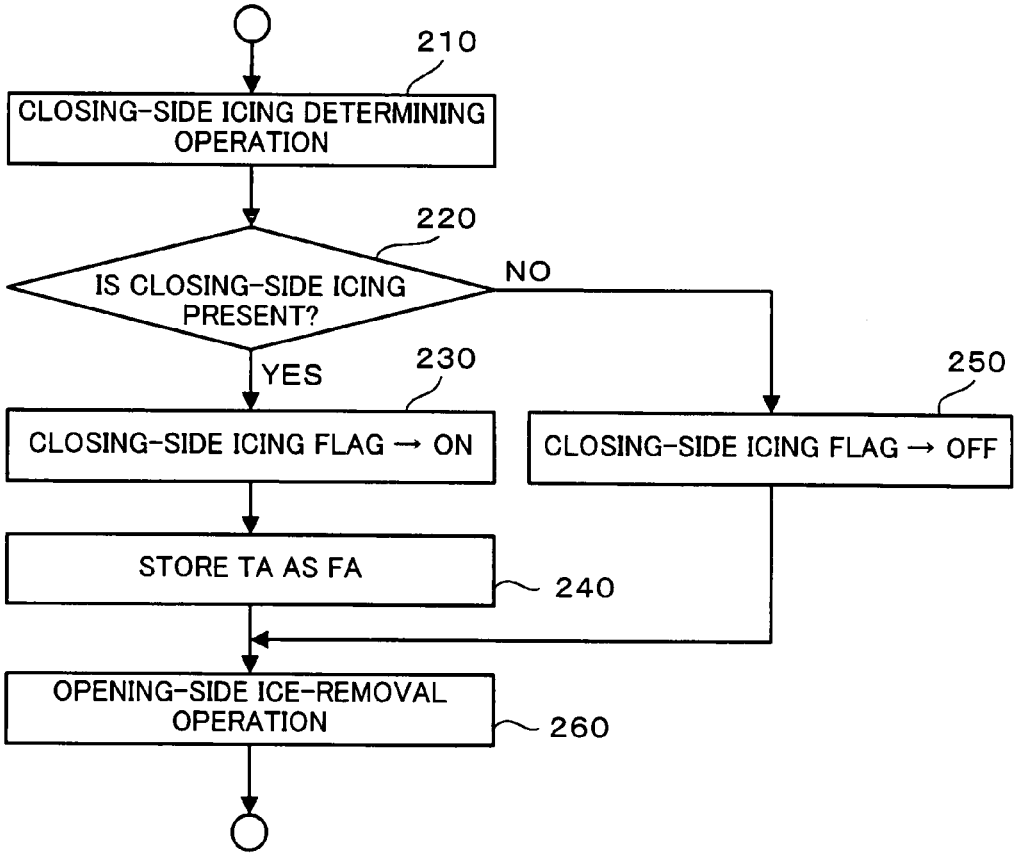
FIG. 7 is a flowchart showing contents of the icing elimination control.

The contents of the icing elimination control to be executed by the ECU 2 will be explained below in detail referring to FIGS. 6 to 21. FIGS. 6 and 7 are flowcharts showing the contents of the icing elimination control. The ECU 2 executes this routine periodically at regular intervals.

FIG. 6 is a flowchart showing the overall flow of the icing elimination control. At the start of processing of this routine, the ECU 2 waits for an ignition (IG) to be turned on by operation of the ignition switch 35 in step 100, and then proceeds to step 110. In step 110, the ECU 2 reads the intake temperature THA and the cooling water temperature THW detected by the intake temperature sensor 31 and the water temperature sensor 33 respectively.

In step 120, based on the read intake temperature THA and cooling water temperature THW, the ECU 2 then determines whether or not a low-temperature condition is met. Specifically, on the basis that the outside air and the engine 3 are in the low-temperature condition, the ECU 2 determines whether there is a possibility that icing has occurred on the throttle valve 6. If this determination result is negative, the ECU 2 temporarily terminates the subsequent processing. If this determination result is affirmative, to the contrary, which indicates the low-temperature condition, the ECU 2 judges in step 130 whether or not the IG-ON processing has terminated. This IG-ON processing includes the processing for determining (checking) the icing and the processing for removing the ice. In the case where the IG-ON processing has been terminated, the ECU 2 advances to step 140. In the case where the IG-ON processing has not been terminated, the ECU 2 executes the IG-ON processing in step 200 and advances to step 140. The contents of this IG-ON processing will be mentioned later.

In step 140, the ECU 2 determines whether or not the engine 3 has started, based on the rotational speed NE detected by the rotational speed sensor 34. If this determination result is negative, the ECU 2 temporarily terminates the subsequent processing. If the determination result is affirmative, the ECU 2 executes the closing-side ice-removal processing after the start of the engine 3 in step 300 and temporarily terminates the subsequent processing. This closing-side ice-removal processing will also be mentioned later in detail.

The contents of the aforementioned "IG-ON processing" in step 200 are explained below with reference to FIG. 7, showing a flowchart of this IG-ON processing.

In step 210, the ECU 2 executes the closing-side icing determining operation. Specifically, the ECU 2 controls the motor 7 to drive the throttle valve 6 to the closing side in order to determine whether the throttle valve 6 cannot move to the closing side, namely, it is in a "closing-side icing state". For this end, the ECU 2 controls the motor 7 by assuming that an opening degree ("eqg" opening) at which the throttle valve 6 is slightly opened than at the full closed position is a predetermined opening degree. Before the start of the engine 3, the throttle valve 6 has been held in the opener opening-degree at which the throttle valve 6 is slightly opened than at the full closed position by the opener mechanism 9. Accordingly, the throttle valve 6 is made to move from this opener opening-degree toward the full closed position. However, when the icing has occurred on the throttle valve 6 on the closing side, the throttle valve 6 is seized in the bore 5*a* and hard to move. When the icing has not occurred on the throttle valve 6 on the closing side, on the other hand, the throttle valve 6 is allowed to move in the closing direction up to the predetermined opening degree.

Figure 9:
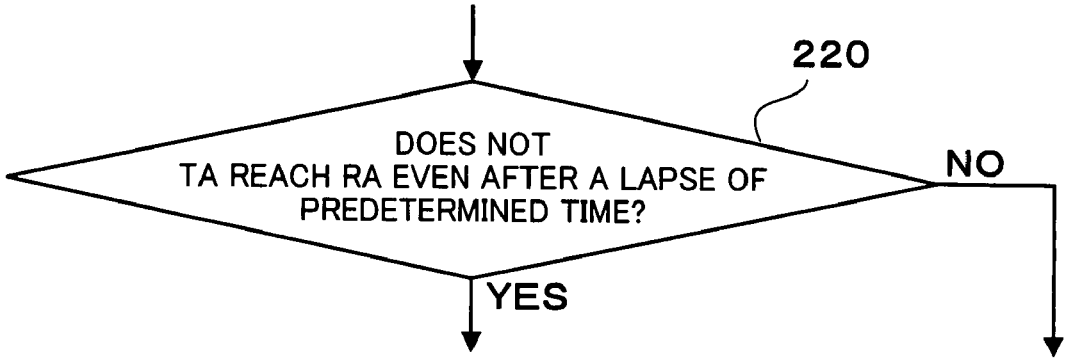
FIG. 9 is a view showing the contents of closing-side icing determination.

In step 220, the ECU 2 determines whether the closing-side icing is present. For this determination, particularly, in the present embodiment, it is judged whether or not the actual opening degree TA reaches the target opening degree RA even after a predetermined time (e.g. 2 seconds or less) has elapsed from the processing start in step 210, as shown in FIG. 9. Herein, the target opening degree RA is assumed to be the "full closed position". In other words, when the actual opening degree TA does not become the full closed position even though the motor 7 is driven for the predetermined time, the ECU 2 judges that the throttle valve 6 has not actually moved and thus the "closing-side icing" is present. Returning to FIG. 7, when the "closing-side icing" is present, the ECU 2 sets a closing-side icing flag to ON in step 230, stores the actual opening degree TA at the time as an opening degree FA of the throttle valve 6 in an icing state (i.e. in a frozen state) (hereinafter, simply referred to as an "icing opening degree FA") in the RAM in step 240, and then proceeds to step 260. When the closing-side icing is absent, the ECU 2 sets the closing-side icing flag FA to OFF and advances to step 260. Briefly, in steps 210 to 250, the ECU 2 determines whether the icing of the throttle valve 6 has occurred before the start of the engine 3.

In step 260 following step 240 or 250, the ECU 2 executes an opening-side ice-removal operation. The ECU 2 instantaneously sets the target opening degree RA to a relatively large value and controls the motor 7 to open the throttle valve 6 to the target opening degree RA in order to eliminate the icing on the opening side. At this time, the ECU 2 sets the target opening degree RA to for example "10° or more". The ECU 2 supplies a motor current or driving duty DY for causing the motor 7 to produce required driving torque. This "required driving torque" is a value equal to or larger than the torque allowing removal of the icing and equal to or lower than the torque ensuring enough strength and abrasion resistance of driving parts such as gears to prevent breakage.

Figure 8:
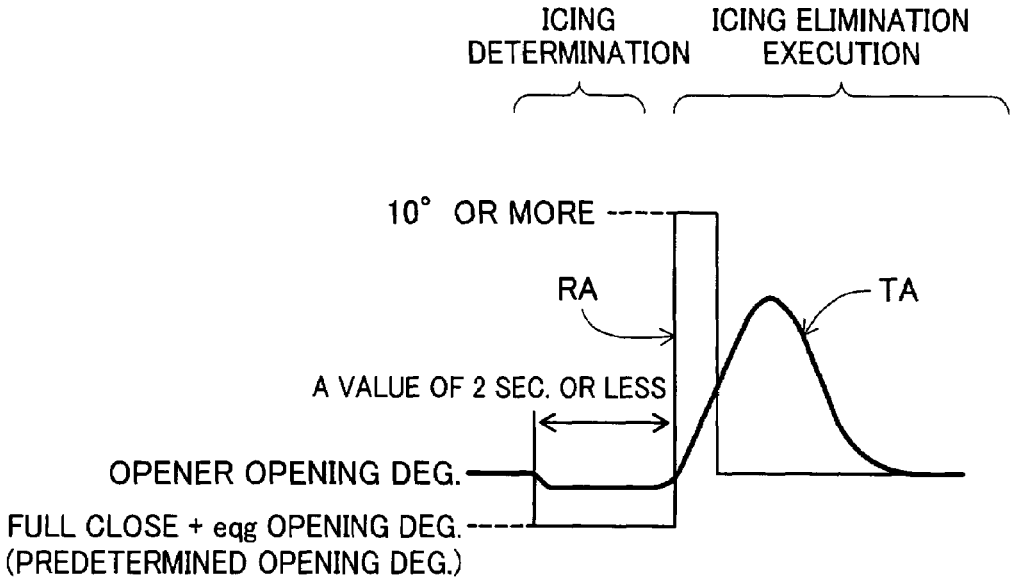
FIG. 8 is a time chart showing behaviors of actual and target opening degrees in IG-ON processing.

FIG. 8 is a time chart showing behaviors of the actual opening degree TA and the target opening degree RA in the "IG-ON processing". As shown in FIG. 8, the "closing-side icing determining operation" is executed within initial two seconds, thereby implementing the "icing determination (icing check)". At this time, if it is determined that the "closing-side icing is present", the actual opening degree TA at the time is stored as the icing opening degree FA. Then, during a period of the "icing elimination execution", the target opening degree RA is set to "10° or more" according to the "opening-side ice-removal operation". The throttle valve 6 is thus caused to largely move at once with the result of an instant large increase or decrease of the actual opening degree TA. By this opening-side ice-removal operation, it is possible to break the ice formed on the downstream side of the throttle valve 6.

Figure 10:
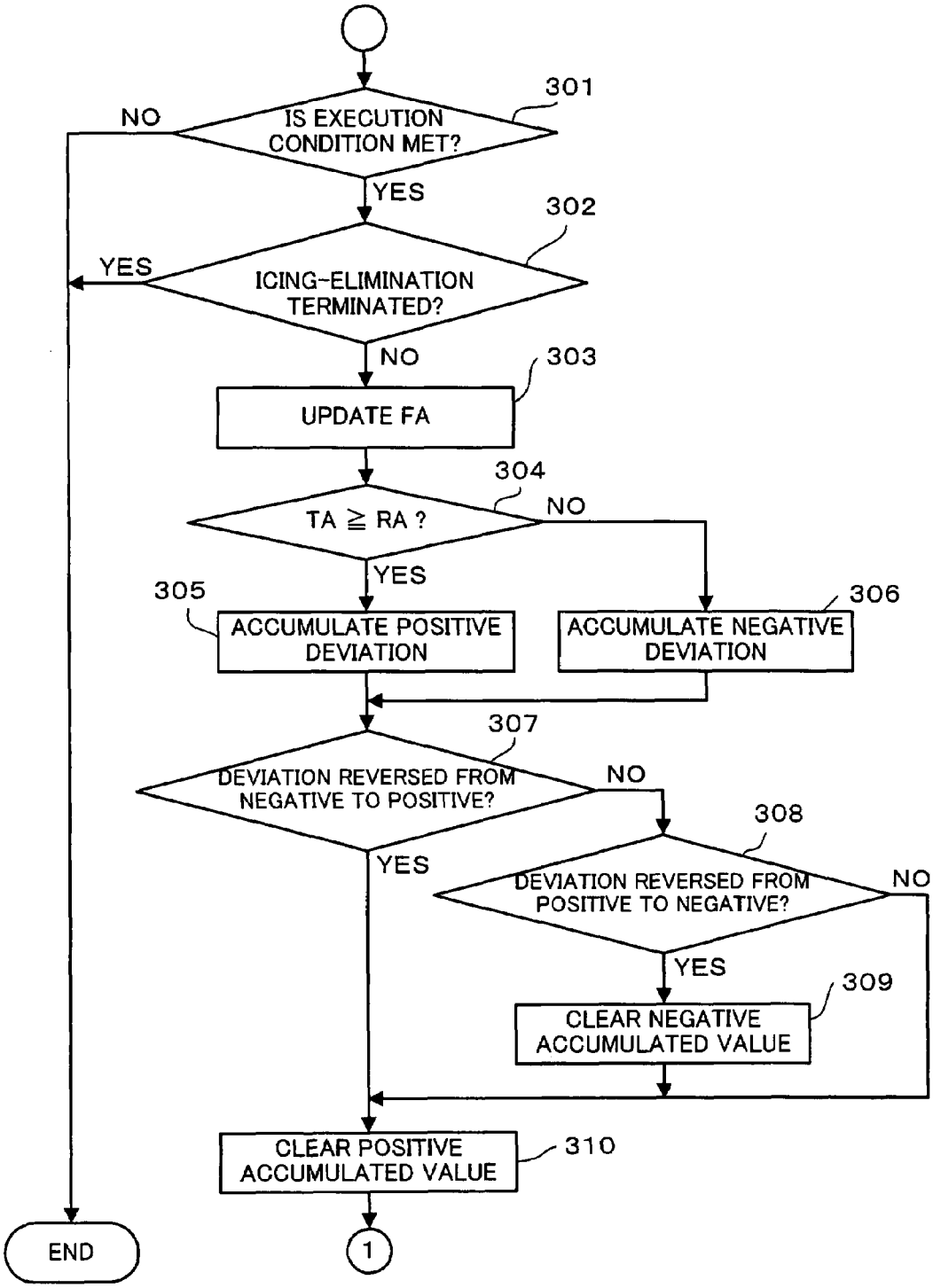
FIG. 10 is a flowchart showing the contents of closing-side ice-removal processing.
Figure 11:
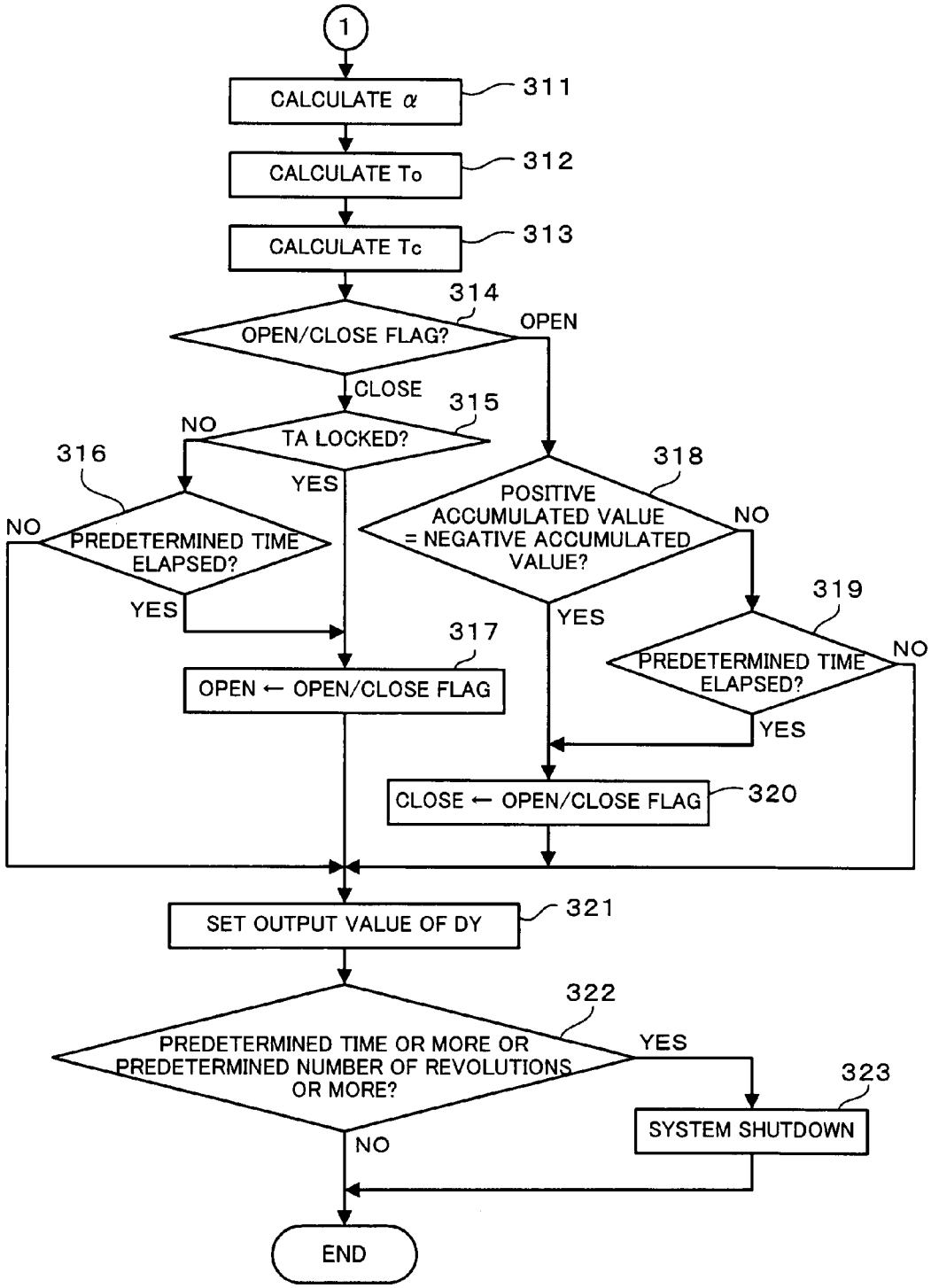
FIG. 11 is a flowchart showing the contents of the closing-side ice-removal processing.
Figure 12:
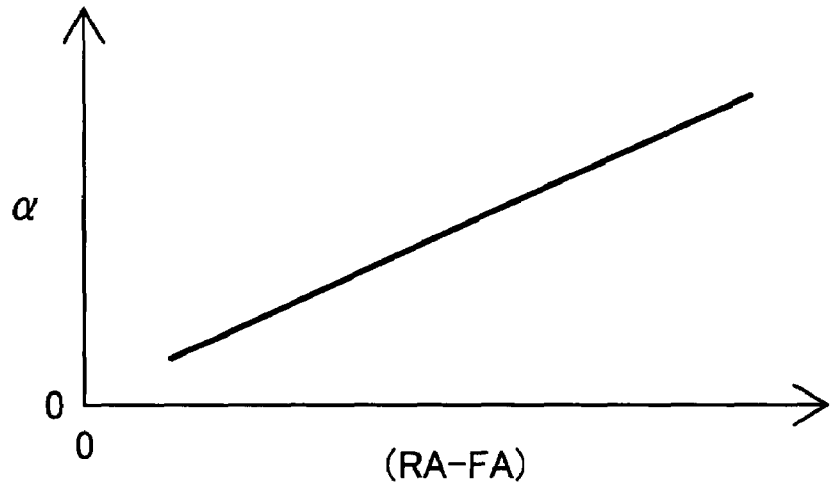
FIG. 12 is a map showing a relationship of an area correction coefficient with respect to a deviation between the target opening degree and an icing opening degree.
Figure 13:
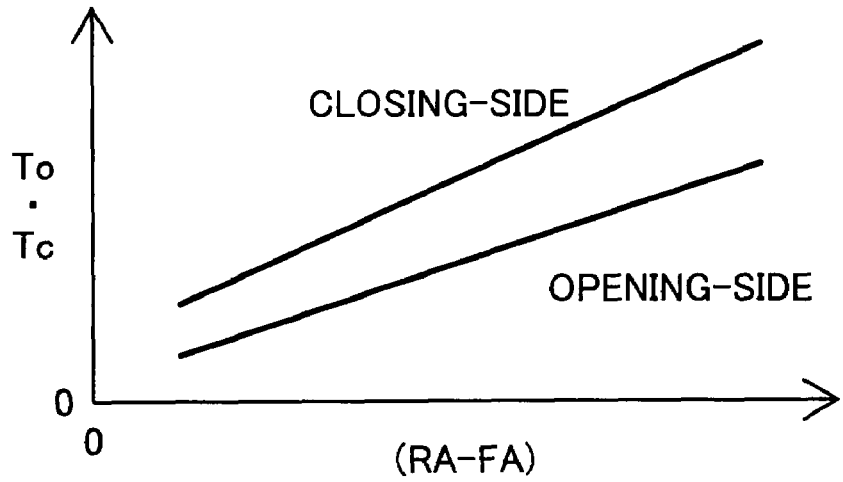
FIG. 13 is a map showing a relationship of opening-side and closing-side reverse times with respect to a deviation between the target opening degree and the icing opening degree.

The following explanation is made on the contents of the aforementioned "closing-side ice-removal processing" in step 300, with reference to FIGS. 10 and 11 which are flowcharts showing this closing-side ice-removal processing.

In step 301, the ECU 2 first determines whether or not execution conditions for the closing-side ice-removal processing are met. For example, when the accelerator pedal 10 is not operated and the aforementioned closing-side icing flag is turned ON, the ECU 2 determines that the execution conditions are met. As to whether or not the accelerator pedal 10 is not operated, the ECU 2 can judge based on a detection signal from the accelerator sensor 11. When the execution conditions are not met, the ECU 2 temporarily terminates the subsequent processing. When the execution conditions are met, the ECU 2 proceeds to step 302.

In step 302, the ECU 2 determines whether or not the icing elimination has been terminated. When the icing elimination has been terminated, the ECU 2 temporarily terminates the subsequent processing. When the icing elimination is not terminated, the ECU 2 proceeds to step 303.

In step 303, the ECU 2 updates the icing opening degree FA and stores the updated value. This updated icing opening degree FA means the actual opening degree TA stored as the icing opening degree FA in step 240 of FIG. 7.

In step 304, the ECU 2 determines whether or not the actual opening degree TA is equal to or larger than the target opening degree RA. If TA is RA or more, the ECU 2 accumulates a positive deviation between TA and RA in step 305 and then proceeds to step 307. If TA is smaller than RA, the ECU 2 accumulates a negative deviation between TA and RA and then advances to step 307.

In step 307 following step 305 or 306, the ECU 2 determines whether or not the deviation between the actual opening degree TA and the target opening degree RA has been reversed from negative to positive. If this determination result is affirmative (YES), the ECU 2 clears the positive accumulated value in step 310. If the determination result is negative (NO), on the other hand, the ECU 2 further judges in step 308 whether or not the deviation between the actual opening degree TA and the target opening degree RA has been reversed from positive to negative. If this judgment result is negative (NO), the ECU 2 clears the positive accumulated value in step 310. If the judgment result in step 308 is affirmative (YES), on the other hand, the ECU 2 clears the negative accumulated value in step 309 and then clears the positive accumulated value in step 310.

Specifically, in the above step 304 to 310, the ECU 2 calculates an accumulated value of the deviation between the actual opening degree TA and the target opening degree RA.

In step 311, the ECU 2 successively calculates an area correction coefficient $\alpha$. Here, the ECU 2 calculates the area correction coefficient $\alpha$ from the deviation between the target opening degree RA and the icing opening degree FA by referring to a map shown in FIG. 12. The ECU 2 then calculates an opening-side reverse time To in step 312 and calculates a closing-side reverse time Tc in step 313. Here, the ECU 2 calculates the opening-side reverse time To and the closing-side reverse time Tc from a deviation between the target opening degree RA and the icing opening degree FA by referring to a map shown in FIG. 13. In those sequential steps 311 to 313, the ECU 2 performs preprocessing for determination.

In step 314, the ECU 2 determines whether an open/close flag is "OPEN" or "CLOSE". If this flag is "OPEN", the ECU 2 proceeds to step 315. In step 315, the ECU 2 determines whether the actual opening degree TA is in a locked state. Specifically, the ECU 2 judges whether the actual opening degree TA remains unchanged. If this determination result is affirmative, the ECU 2 sets the open/close flag to "OPEN" in step 317 and proceeds to step 321. If this determination result is negative, on the other hand, the ECU 2 further judges in step 316 whether a predetermined time has elapsed. This predetermined time corresponds to the aforementioned closing-side reverse time Tc. If this judgment result in step 316 is affirmative, the ECU 2 sets the open/close flag to "OPEN" in step 317 and proceeds to step 321. If this judgment result in step 316 is negative, on the other hand, the ECU 2 directly proceeds to step 321.

In step 314, it is determined that the open/close flag is "OPEN", the ECU 2 advances to step 318. In step 318, the ECU 2 determines whether or not an absolute value of the aforementioned positive accumulated value is equal to an absolute value of the negative accumulated value. This determination is made in order to reverse the driving duty DT in good time just before (the absolute values of) the positive accumulated value and the negative accumulated value coincide. If this determination result is affirmative, the ECU 2 sets the open/close flag to "CLOSE" in step 320 and proceeds to step 321. If this determination result in step 318 is negative, on the other hand, the ECU 2 further determines in step 319 whether a predetermined time has elapsed. This predetermined time is the aforementioned opening-side reverse time To. If the determination result in step 319 is affirmative, the ECU 2 sets the open/close flag to "CLOSE" in step 320 and proceeds to step 321. If the determination result in step 319 is negative, on the other hand, the ECU 2 directly proceeds to step 321.

In other words, in the above steps 314 to 320, the ECU 2 executes the determination of opening/closing of the throttle valve 6.

In step 321 following steps 316, 317, 319, or 320, the ECU 2 sets an output value of the driving duty DT to a predetermined value. At that time, in response to the open/close flag being turned to "OPEN" or "CLOSE", the ECU 2 sets the driving duty DY to for example "+20% to +100%" or "−20% to −100%" in order to cause the motor 7 to produce driving torque at a value for required torque.

In other words, in the above steps 301 to 321, the ECU 2 supplies the driving duty DY to cause the motor 7 to produce required driving torque to eliminate the icing of the throttle valve 6 and reverses the driving duty DY by open control. The ECU 2 additionally controls the motor 7 to bring the accumulated value of the deviation between the target opening degree RA of the throttle valve 6 and the detected actual opening degree TA (the stored icing opening degree FA) to zero. Further, the ECU 2 changes the area correction coefficient $\alpha$, opening-side reverse time To, and closing-side reverse time Tc, which are parameters for the above controls, according to the deviation between the target opening degree RA and the icing opening degree FA.

Thereafter, for executing failure or fault diagnosis for the throttle control device, the ECU 2 determines in step 322 whether a predetermined time has elapsed or a predetermined number of revolutions has passed. This predetermined time corresponds to the time for which the motor 7 is driven for icing elimination and may be set to e.g. a "value of 2 seconds or less". Similarly, the predetermined number of revolutions corresponds to the number of revolutions the motor 7 is driven for icing elimination and may be set to e.g. a "value of 100 revolutions or less". If this judgment result is affirmative, the ECU 2 regards that a fault has occurred in the throttle control device and, in step 323, causes system shutdown and temporarily terminates the subsequent processing. If no fault has occurred in the throttle control device, the processing following step 322 temporarily ends. Here, the contents of the system shutdown include that the ECU 2 terminates driving of the motor 7 and turns on an alarm lamp 36, and stores a fault code representing the occurrence of a fault in a backup RAM. This fault code is readable as history information of the engine 3 at the time of maintenance.

In the aforementioned "closing-side ice-removal processing", the ECU 2 first drives the motor 7 by open control by assuming the driving duty DT to "+20% to +100%" or "−20% to −100%" in order to cause the motor 7 to produce the required driving torque. To be more precise, the ECU 2 supplies the driving duty DY of "+20% to +100%" to the motor 7 and also reverses the driving duty DY by open control. The ECU 2 subsequently operates the throttle valve 6 to open and close so that the accumulated value of the deviation between the target opening degree RA and the actual opening degree TA (the stored icing opening degree FA) reaches zero.

Accordingly, while satisfying the intake-air flow rate QA required by the engine 3, the throttle valve 6 is caused to swing.

Figure 14:
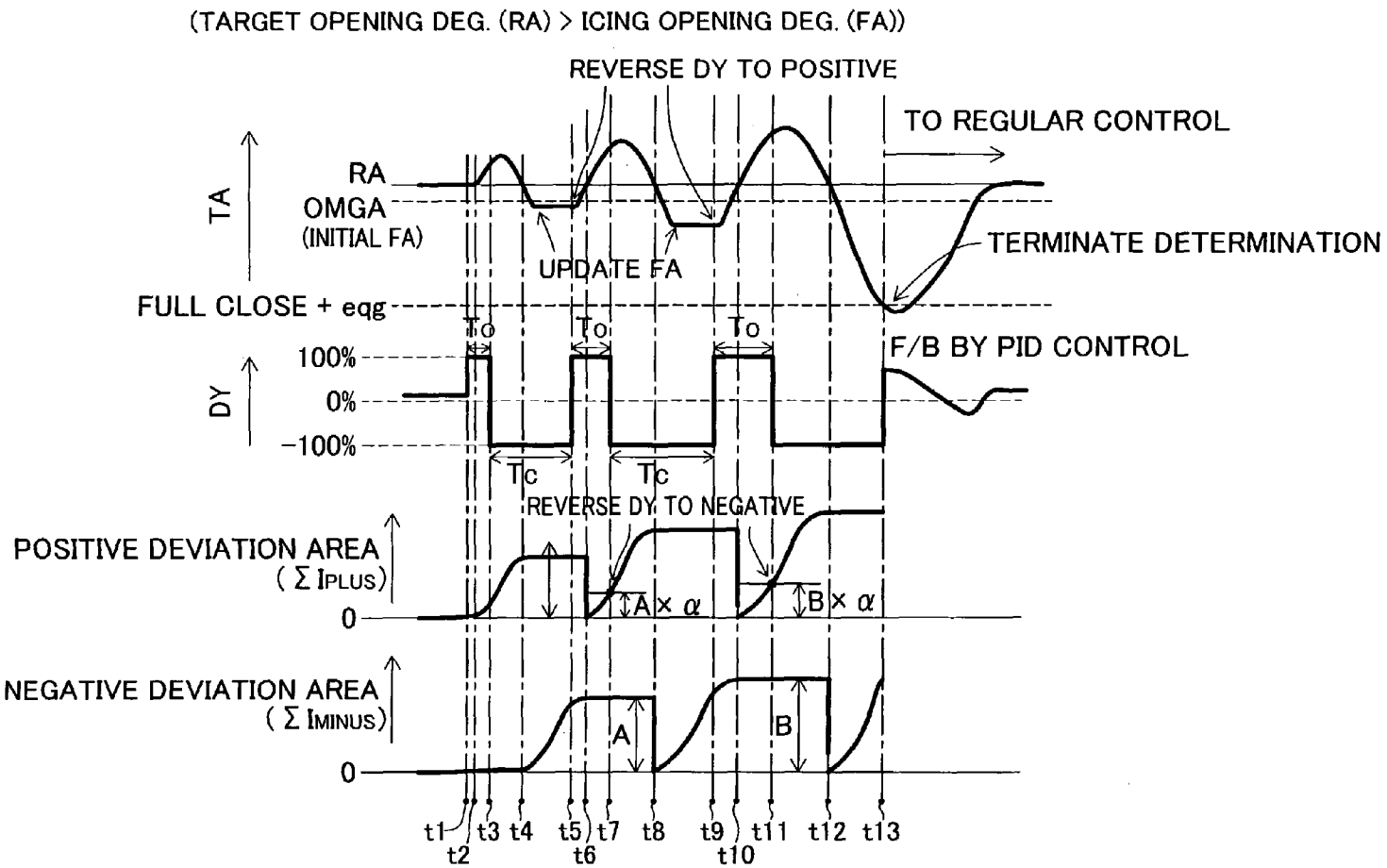
FIG. 14 is a time chart showing behaviors of various parameters in the closing-side ice-removal processing.

FIG. 14 is a time chart, in relation to the "closing-side ice-removal processing", showing behaviors of the actual opening degree TA of the throttle valve, the driving duty DT, the positive deviation area (the positive accumulated value), and the negative deviation area (the negative accumulated value) in the case where the target opening degree RA is larger than the icing opening degree FA.

In FIG. 14, when the driving duty DY is set to a range of "+20% to +100%" at time t1, the actual opening degree TA starts to increase at time t2, causing the positive deviation area to start to increase. Then, at time t3 after the opening-side reverse time To has passed, the driving duty DY is reversed to a range of "−20% to −100%" and, after a slight delay, the actual opening degree TA starts to decrease. At time t4, the actual opening degree TA starts to fall below the target opening degree RA and accordingly the negative deviation area starts to increase. At this time, the throttle valve 6 is driven to move in the closing direction, thus giving impact to the ice on the throttle valve 6. The actual opening degree TA falls slightly below an initial icing opening degree OMGA (an icing opening degree FA initially stored). The actual opening degree TA is updated at the time and stored as a new icing opening degree FA.

After the closing-side reverse time Tc has passed from the time t3, the driving duty DY is reversed to a range of "+20% to +100%" at time t5 and, after a slight delay, the actual opening degree TA starts to increase. When the actual opening degree TA exceeds the target opening degree RA at time t6, the positive deviation area is reset to "0" and then starts to increase again. Then, after a lapse of the opening-side reverse time To, the driving duty DY is reversed to a range of "−20% to −100%" at time t7 and, after a slight delay, the actual opening degree TA starts to decrease. At time t8, the actual opening degree TA falls below the target opening degree RA and accordingly the negative deviation area is reset to "0" and then starts to increase again. At this time, further impact is given to the ice around the throttle valve 6, so that the actual opening degree TA falls below the previous icing opening degree FA. The actual opening degree TA is updated at the time and stored as a new icing opening degree FA.

After a lapse of the closing-side reverse time Tc from time t7, the driving duty DY is reversed to a range of "+20% to +100%" at time t9 and, after a slight delay, the actual opening degree TA starts to increase. When the actual opening degree TA exceeds the target opening degree RA at time t10, the positive deviation area is reset to "0" and then starts to increase again. At time t11 after the opening-side reverse time To has passed, the driving duty DY is reversed to a range of "−20% to −100%" and, after a slight delay, the actual opening degree TA starts to decrease. At time t12, the actual opening degree TA falls below the target opening degree RA and accordingly the negative deviation area is reset to "0" and then starts to increase again. When the ice around the throttle valve 6 is removed by impact given thereto, the actual opening degree TA can be changed to the full closed position. At time t13, the "closing-side ice-removal processing" is terminated. The driving duty DY is fed back by normal PID control. The flow goes to regular control.

As clearly found from FIG. 14, the reverse of the driving duty DY from an opening side to a closing side is controlled according to the area of a deviation (deviation area) of the actual opening degree TA with respect to the target opening degree RA. After the reverse, a time restriction is applied to such reverse by the opening-side reverse time To. On the other hand, the reverse of the driving duty DY from a closing side to an opening side is achieved when impact or impingement of the throttle valve 6 on the icing is detected. After the reverse, a time restriction is applied to such reverse by the closing-side reverse time Tc. The opening-side reverse time To and the closing-side reverse time Tc are calculated by referring to the map shown in FIG. 13. The reverse of the driving duty DY is executed at early timing in prospect of a response delay of the throttle valve 6.

Figure 15:
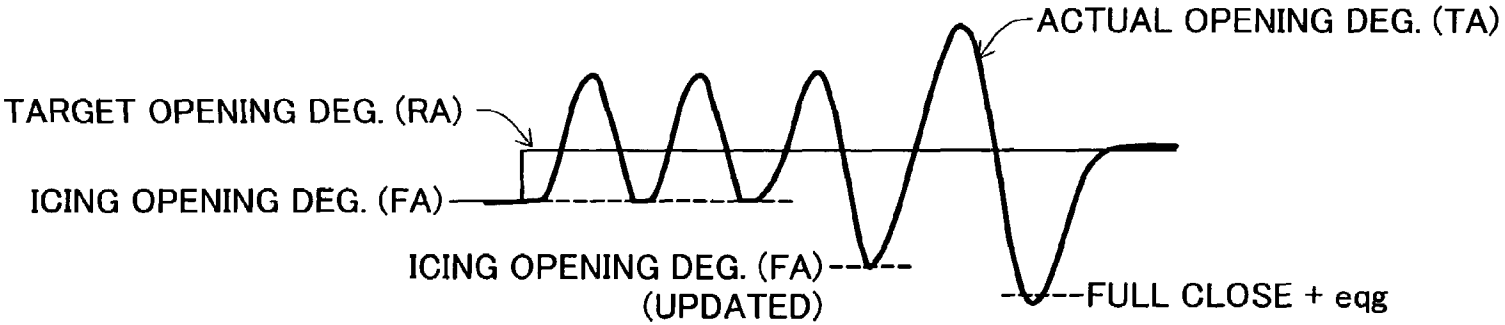
FIG. 15 is a time chart showing behaviors of the actual opening degree, the target opening degree, and the icing opening degree.

Specifically, according to the aforementioned "closing-side ice-removal processing", the ice-removal operation is implemented after the start of the engine 3, as shown in FIG. 15, the throttle valve 6 is caused to repeatedly swing about the target opening degree RA, the icing opening degree FA is updated and stored when the icing opening degree FA comes loose, and the ice-removal operation is continued until the actual opening degree TA reaches the full closed position, that is, the throttle valve 6 moves to near the full closed position. By this "closing-side ice-removal processing", it is possible to cause the throttle valve 6 to repeatedly impinge on the ice formed on the upstream side of the throttle valve 6 with an impact force to break the ice.

Here, the icing elimination mechanism using the aforementioned icing elimination control is explained with reference to FIGS. 16 to 19. When the icing occurs around the throttle valve 6, the ice Ic tends to grow in both directions, upstream and downstream of the throttle valve 6, as shown in FIG. 16.

Figure 16:
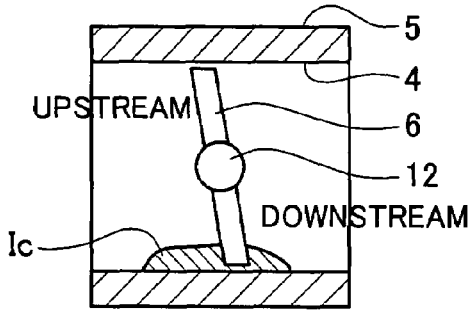
FIG. 16 is a cross section of a throttle body, showing an icing elimination mechanism.
Figure 17:
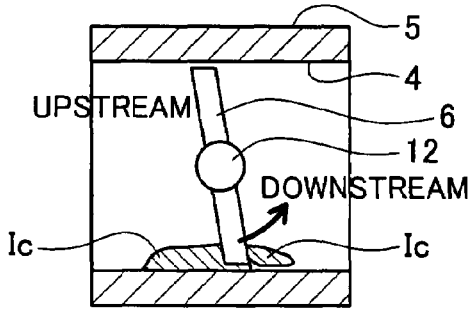
FIG. 17 is a cross section of the throttle body, showing the icing elimination mechanism.

In the "IG-ON processing", when it is determined before the start of the engine 3 that the icing is present on the closing side of the throttle valve 6, the throttle valve 6 in the state shown in FIG. 16 is caused to move one time in the opening direction by the "opening-side ice-removal operation". Accordingly, as shown in FIG. 17, the ice Ic on the downstream side of the throttle valve 6 is broken away.

Figure 18:
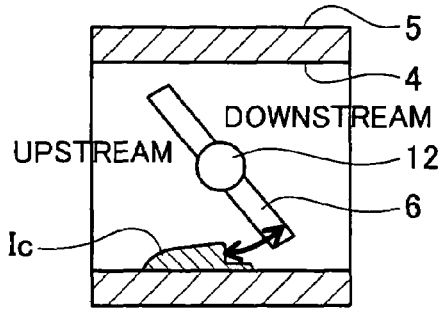
FIG. 18 is a cross section of the throttle body, showing the icing elimination mechanism.
Figure 19:
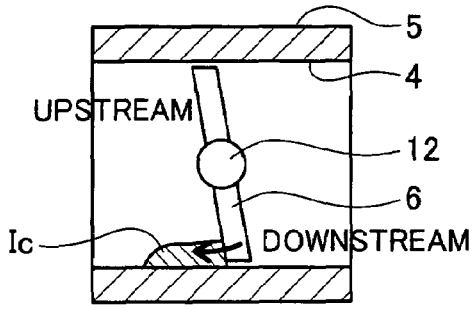
FIG. 19 is a cross section of the throttle body, showing the icing elimination mechanism.

Upon start of the engine 3, in the "closing-side ice-removal processing", as shown in FIG. 18, the throttle valve 6 is driven to move in the closing direction from the open position, thereby impinging on the ice Ic. The throttle valve 6 is swung to repeatedly impinge on the ice Ic to repeatedly give an impact force to the ice Ic. It is therefore possible to break away the ice Ic on the upstream side of the throttle valve 6 as shown in FIG. 19, so that the ice on or around the throttle valve 6 can completely be removed.

The throttle control apparatus in the present embodiment described above is arranged to determine in the "icing determination" that the icing occurs on or around the throttle valve 6 when the detected actual opening degree TA does not reach the target opening degree RA even though the motor 7 is controlled to operate for a predetermined time. Here, this case where the actual opening degree TA does not reach the target opening degree RA even after a lapse of the predetermined time from the start of control of the motor 7 means the case where the throttle valve 6 does not move up to the target opening degree RA because the motor 7 cannot operate appropriately even though the motor 7 is controlled so as to operate for the predetermined time. Accordingly, the case where the throttle valve 6 does not come up to the target opening degree RA even when the motor 7 is actually driven is determined as that the throttle valve 6 is frozen. Thus, the icing (freezing) of the throttle valve 6 is actually detected. Irrespective of differences in environmental conditions, consequently, it is possible to reliably detect the icing of the throttle valve 6. Since the icing of the throttle valve 6 can reliably be detected as above, the ice-removal operation of the throttle valve 6 can be restrictively executed only when needed. This makes it possible to reduce consumption of electric energy of the motor 7, thus preventing deterioration in durability of the motor 7.

According to the present embodiment, by the "opening-side ice-removal operation" executed in the "IG-ON processing", the throttle valve 6 is caused to move once in the opening direction before the start of the engine 3 to start removing the ice. This makes it possible to early eliminate the icing of the throttle valve 6 in good time before the start of the engine 3, thus allowing the throttle valve 6 to open and close appropriately by regular control. Since the throttle valve 6 is driven in the opening direction, the throttle valve 6 is allowed to move at a large operation angle and accordingly at a high operating speed. Accordingly, the throttle valve 6 can first produce the effective impact force for ice removal, which makes it possible to effectively cope with icing of the throttle valve 6 to remove the solid ice. Further, in this "opening-side ice-removal operation", the driving duty DY is supplied to cause the motor 7 to produce the required driving torque. It is therefore possible to speed up the operation of the throttle valve 6 to the maximum, giving an effective impact force for breaking the ice. This can effectively cope with the icing of the throttle valve 6 to remove the solid ice.

According to the present embodiment, in the "closing-side ice-removal processing", the driving duty DY is set to either "+20% to +100%" or "−20% to −100%" to eliminate the icing of the throttle valve 6, thereby causing the motor 7 to produce the required driving torque. Thus, the operation of the throttle valve 6 is speeded up, producing an effective impact force for breaking the ice. In addition, the driving duty DY to be supplied to the motor 7 is reversed by open control, so that the driving torque of the motor 7 is increased to raise the operating speed of the throttle valve 6. The motor 7 is further controlled to cause the accumulated value of the deviation between the target opening degree RA of the throttle valve 6 and the stored icing opening degree FA to reach "zero". Accordingly, the throttle valve 6 is caused to swing to bring the intake-air flow rate QA closer to the target flow rate and also restrain the amount of change in the intake-air flow rate QA. Thus, the throttle valve 6 repeatedly impinges on the ice, repeatedly giving an impact force to the ice. Destructive power of the throttle valve 6 to the ice can therefore be so increased as to more reliably eliminate the hard icing of the throttle valve 6. It is further possible to restrain the variations in the intake-air flow rate due to swing of the throttle valve 6 and thus reduce output power variation of the engine 3. This makes it possible to remove the ice in a wider area while restraining the amount of change in the intake-air flow rate QA due to the swing of the throttle valve 6.

In the present embodiment, particularly, the motor 7 is controlled to bring the accumulated value of the deviation between the target opening degree RA of the throttle valve 6 and the stored icing opening degree FA to "zero". For this end, the parameters for such control; the area correction coefficient $\alpha$, opening-side reverse time To, and closing-side reverse time Tc are changed according to the deviation between the target opening degree RA and the icing opening degree FA. Thus, the convergence property of the intake-air flow rate QA to the target amount can be improved. It is therefore possible to accurately restrain the amount of change in the intake-air flow rate due to the throttle valve 6, reducing the output power variation of the engine 3.

In the present embodiment, in the "closing-side ice-removal processing", the motor 7 is controlled to operate until the throttle valve 6 moves to near the full closed position, thereby removing the ice around the closed position. It is accordingly possible to remove the ice formed in a wider area around the full closed position.

In the present embodiment, in the "IG-ON processing", it is determined whether or not the throttle valve 6 is frozen before the start of the engine 3. If it is determined that the throttle valve 6 is frozen, the actual opening degree TA at the time is stored as the icing opening degree FA. In the "closing-side ice-removal processing", the throttle valve 6 is caused to swing based on the icing opening degree FA stored before the start of the engine 3. Accordingly, with respect to the icing determined before the start of the engine 3, the throttle valve 6 is caused to swing only after the throttle valve 6 moves close to the icing opening degree FA after the start of the engine 3. Consequently, it is possible to activate the motor 7 to swing the throttle valve 6 only when the throttle valve 6 moves close to the icing opening degree FA which needs the ice removal. This makes it possible to prevent excess electrical energy consumption of the motor 7.

In the present embodiment, when the icing comes loose during warp-up after the start of the engine 3 (i.e. during first idling), the actual opening degree TA is updated to the value detected at the time and stored as the icing opening degree FA. Since the motor 7 is controlled based on the updated icing opening degree FA to swing the throttle valve 6, the operating range of the throttle valve 6 is changed as the icing state comes loose. The icing (ice) will therefore be eliminated effectively at early stage after the start of the engine 3. The throttle valve 6 can appropriately be opened and closed by regular control after the start of the engine 3. The ice-removal processing is performed during warm-up in which an engine sound is relatively large, which makes the noise of the throttle valve 6 impinging on the ice hard to hear.

In the present embodiment, the control (operation) of the motor 7 is stopped when a fault related to the throttle valve 6 or motor 7 is detected, which does not have the motor 7 operate unnecessarily when the fault occurs. Since the motor 7 is not forced to operate when the fault occurs, the motor 7 can be prevented from deteriorating and excess electric energy consumption can also be restrained.

Second Embodiment

A second embodiment of the throttle control apparatus for an internal combustion engine according to the present invention will be described in detail with reference to the accompanying drawings.

Figure 20:
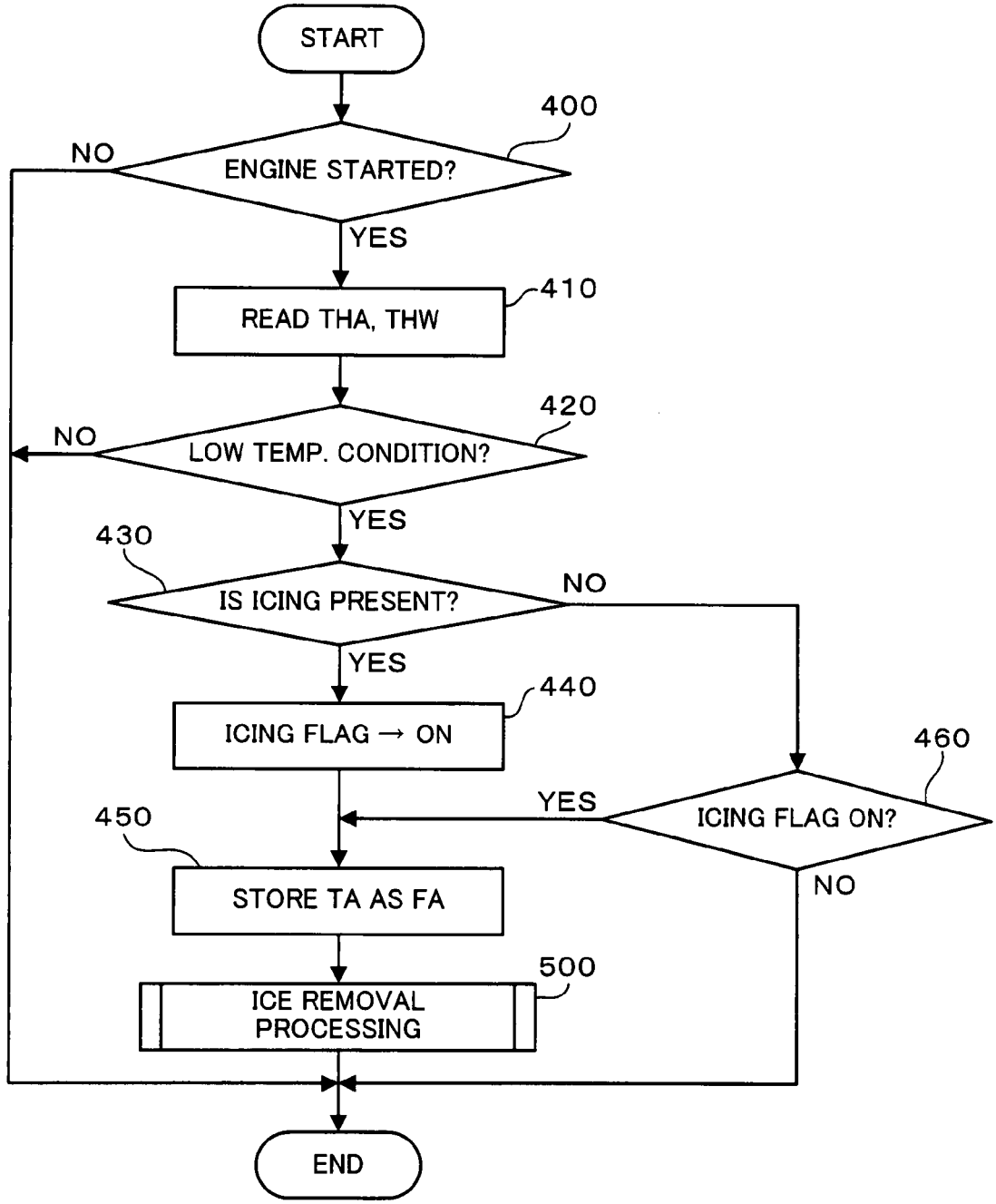
FIG. 20 is a flowchart showing the contents of the icing elimination control.

In the present embodiment, the contents of the icing elimination control are different in structure from those in the first embodiment. Particularly, this embodiment is directed to the control for coping with the icing occurring after the start of the engine 3. FIG. 20 is a flowchart showing the overall flow of the icing elimination control. The ECU 2 executes this routine periodically at predetermined time intervals.

When the processing according to this routine starts, the ECU 2 determines in step 400 whether or not the engine 3 has started. The ECU 2 makes this determination based on the rotational speed NE detected by the rotational speed sensor 34. If the engine 3 has not been started, the ECU 2 temporarily terminates the subsequent processing. If the engine 3 has started, the ECU 2 reads in step 410 the intake temperature THA and the cooling water temperature THW detected by the intake temperature sensor 32 and the water temperature sensor 33 respectively.

In step 420, based on the read intake temperature THA and cooling water temperature THW, the ECU 2 determines whether or not a low-temperature condition is met. Specifically, the ECU 2 determines whether or not there is a possibility that the icing has occurred around the throttle valve 6 because the outside air and the engine 3 are in the low-temperature condition. If the low-temperature condition is not met, the ECU 2 temporarily terminates the subsequent processing. If the low-temperature condition is met, the ECU 2 determines in step 430 whether or not the icing is present, specifically, whether or not the icing has occurred on or around the throttle valve 6. The judging contents are the same as those shown in FIG. 9. If the icing is present, the ECU 2 turns the icing flag ON in step 440, stores the actual opening degree TA at the time as the icing opening degree FA in the RAM in step 450, and then proceeds to step 500.

In step 500, the ECU 2 executes the "ice-removal processing" and then temporarily terminates the subsequent processing. The contents of this "ice-removal processing" are the same as those in step 300 of FIG. 6, namely, those shown in FIGS. 10 and 11.

If it is decided in step 430 that the icing is absent, the ECU 2 determines in step 460 whether or not the icing flag is "ON". If the icing flag is "ON", the ECU 2 proceeds to step 450. If the icing flag is not "ON", the ECU temporarily terminates the subsequent processing.

According to the icing elimination control in the present embodiment, consequently, it is also determined whether or not the throttle valve 6 is frozen even after the start of the engine 3. If it is determined that the throttle valve 6 is frozen, the motor 7 is controlled to swing the throttle valve 6 for eliminating the icing. It is therefore possible to effectively eliminate the icing of the throttle valve 6 having occurred after the start of the engine 3. Other operations and effects are basically the same as those in the first embodiment.

Figure 21:
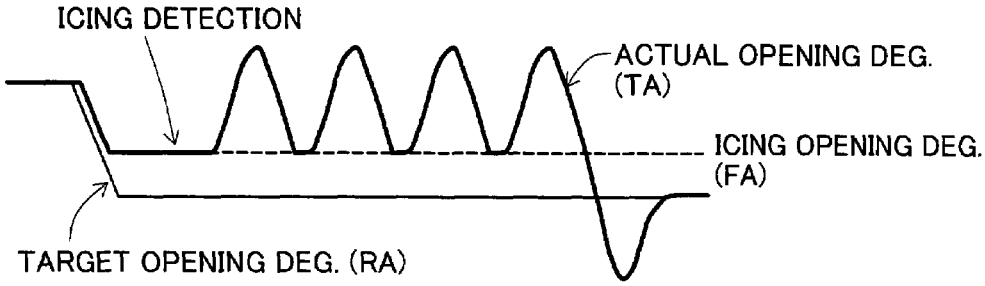
FIG. 21 is a time chart showing behaviors of the actual opening degree, the target opening degree, and the icing opening degree.

Here, FIG. 21 is a time chart showing behaviors of the actual opening degree TA of the throttle valve 6 when the icing elimination control is executed. As is clear from this time chart, when the actual opening degree TA stops following the target opening degree RA due to the icing of the throttle valve 6, the icing is detected and the actual opening degree TA at the time is stored as the icing opening degree FA. Then, the throttle valve 6 is caused to swing relative to the icing opening degree FA and accordingly the icing is eliminated, so that the actual opening degree TA starts to follow the target opening degree RA.

Third Embodiment

A third embodiment of the throttle control apparatus for an internal combustion engine in the present invention will be explained in detail with reference to the accompanying drawings.

In the present embodiment, the contents of the icing elimination control are different in structure from those in the first embodiment. The present embodiment is specifically different in the processing contents in step 301 in FIG. 10. In the present embodiment, in step 301, the ECU 2 requires that the following conditions for executing the closing-side ice-removal processing are fully met; the accelerator pedal 10 is not operated, the aforementioned closing-side icing flag is "ON", and the deviation between the target opening degree RA and the icing opening degree FA is smaller than a predetermined value A (e.g. 10 deg or less).

In the present embodiment, the ECU 2 determines whether or not the throttle valve 6 is frozen before the start of the engine 3. If it is determined that the throttle valve 6 is frozen, the actual opening degree TA detected at that time is stored as the icing opening degree FA. When the deviation between the target opening degree RA of the throttle valve 6 and the stored icing opening degree FA is larger than the predetermined value A after the start of the engine 3, the ECU 2 interrupts the control of the motor 7 for removing the ice (the control for swinging the throttle valve 6).

According to the present embodiment, for the icing determined before the start of the engine 3, even when the throttle valve 6 is caused to swing by the motor 7 to eliminate the icing after the start of the engine 3, the swinging of the throttle valve 6 by the motor 7 is interrupted as soon as the deviation between the target opening degree RA and the icing opening degree FA exceeds the predetermined value A. It is therefore possible to reduce the swinging range of the throttle valve 6 for ice removal to the predetermined value A or less. This makes it possible to avoid unnecessary driving of the motor 7, preventing unnecessary electric energy consumption of the motor 7 and restraining deterioration in durability of the motor 7. Other operations and effects are basically the same as those in the first embodiment.

Figure 22:
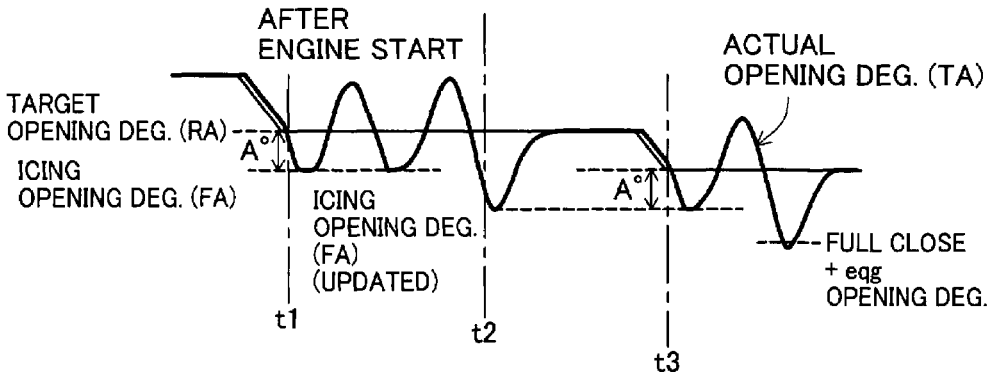
FIG. 22 is a time chart showing behaviors of the actual opening degree, the target opening degree, and the icing opening degree.

FIG. 22 is a time chart showing behaviors of the actual opening degree TA of the throttle valve 6, the target opening degree RA, and the icing opening degree FA in executing the icing elimination control. As is clear from this time chart, when the deviation between the target opening degree RA and the icing opening degree FA is smaller than the predetermined value A at times t1 to t2 after the start of the engine 3, the throttle valve 6 is swung, causing the actual opening degree TA to vary around the target opening degree RA. Then, at time t2, when the deviation between the target opening degree RA and the icing opening degree FA becomes larger than the predetermined value A, the swing of the throttle valve 6 is interrupted and the actual opening degree TA is maintained at the target opening degree RA. At time t3, the deviation between the target opening degree RA and the icing opening degree FA becomes smaller than the predetermined value A again, the throttle valve 6 is swung again, causing the actual opening degree TA to vary around the target opening degree RA. In this way, it is possible to restrain the changing range of the actual opening degree TA of the throttle valve 6 when swung from becoming excessive.

The present invention may be embodied in other specific forms without departing from the essential characteristics thereof. For instance, the configuration of each embodiment described above may partly be modified or changed as below.

In the above embodiments, to determine whether the closing-side icing is present in step 220 of FIG. 7, it is decided whether or not "the actual opening degree TA does not reach the target opening degree RA even after a lapse of the predetermined time" from the processing start in step 210 as shown in FIG. 9. Alternatively, the judgments shown in FIGS. 23 to 28 may be executed for determining whether or not the closing-side icing is present.

Figure 23:
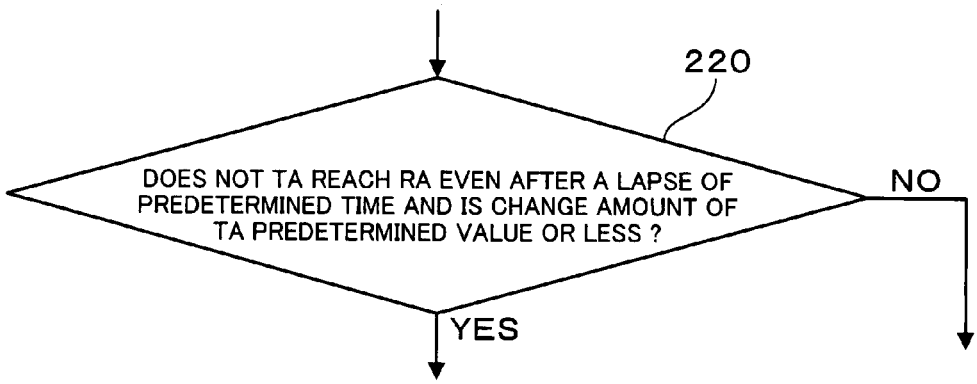
FIG. 23 is a view showing the contents of the closing-side icing elimination determination.

Specifically, as shown in FIG. 23, it may be determined whether or not the actual opening degree TA does not reach the target opening degree RA (the full closed position) even after a lapse of the predetermined time (e.g. 2 sec. or less) from the processing start in step 210 and whether or not the amount of change in the actual opening degree TA is a predetermined value or lower (e.g. 3° or less). In this case, since the judgment of the amount of change in the actual opening degree TA is added to the judging content shown in FIG. 9, it is possible to more accurately obtain substantive motion of the throttle valve 6. In the judging content shown in FIG. 23, the case where the detected actual opening degree TA does not reach the target opening degree RA even after the driving time for controlling the motor 7 exceeds a predetermined time indicates that the throttle valve 6 does not reach the target opening degree RA even though the motor 7 is controlled to operate for a predetermined time or more. Further, the case where the amount of change in the detected actual opening degree TA is a predetermined value or lower indicates that the throttle valve 6 actually hardly moves. The case where the throttle valve 6 does not reach the target opening degree RA even when the motor 7 is actually controlled and the throttle valve 6 actually hardly moves can therefore be regarded as indicating that the throttle valve 6 is frozen. The icing of the throttle valve 6 is thus detected practically. This makes it possible to more reliably detect the presence/absence of the icing of the throttle valve 6 irrespective of differences in environmental conditions.

Figure 24:
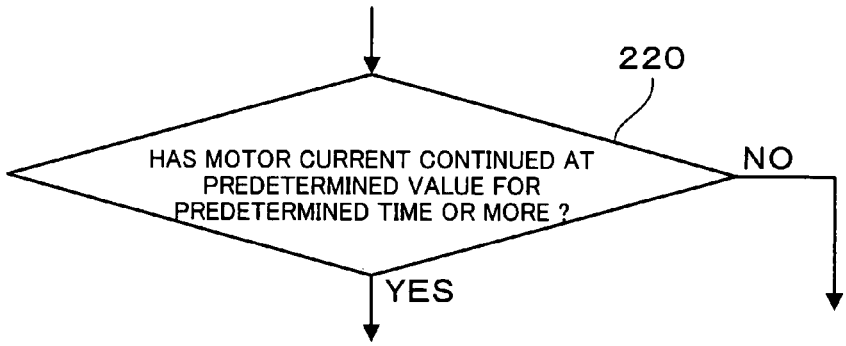
FIG. 24 is a view showing the contents of the closing-side ice-determination.

In the structure that a motor current used as a driving current to be supplied to the motor 7 is controlled to control the output power of the motor 7, as shown in FIG. 24, it may be determined whether or not "the motor current has continued at a predetermined value (e.g. 20% or more of a lock current) or higher for a predetermined time (e.g. 2 sec. or less) or more. Here, the case where motor current continues at the predetermined value or higher for the predetermined time or more indicates that the motor 7 is not operating even though it is supplied with the motor current, that is, the throttle valve 6 is not moving. Similarly in this case, accurately obtaining the substantive motion of the throttle valve 6 makes it possible to determine the presence/absence of the closing-side icing. Here, the case where the motor current continues at the predetermined value or higher for the predetermined time or more in the judging content shown in FIG. 24 indicates that the motor 7 does not operate for the predetermined time or more even though it is controlled so as to operate. The case where the motor 7 is attempting to operate more than necessary, that is, where the throttle valve 6 does not actually move can therefore be regarded as indicating that the throttle valve 6 is frozen. Thus, the icing of the throttle valve 6 can practically be detected. This makes it possible to more reliably detect the presence/absence of the icing of the throttle valve 6 irrespective of differences in environmental conditions.

Figure 25:
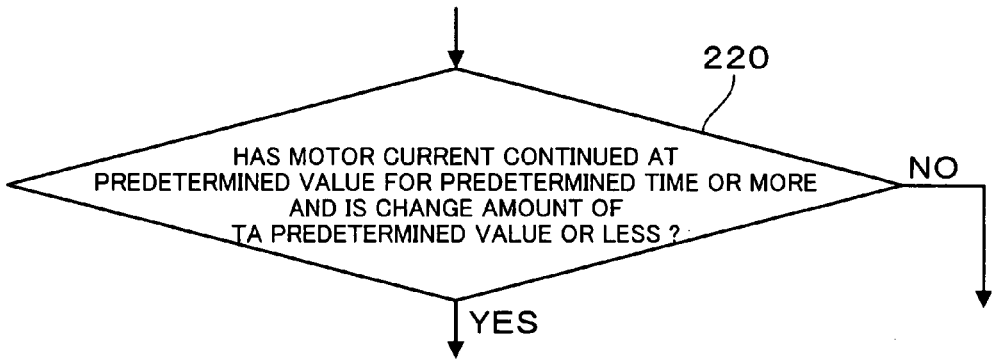
FIG. 25 is a view showing the contents of the closing-side ice-determination.

Further, in the structure that the motor current to be supplied to the motor 7 is controlled to control the output power of the motor 7, as shown in FIG. 25, it may be determined whether or not the motor current has continued at a predetermined value (e.g. 20% or more of a lock current) or higher for a predetermined time (e.g. 2 sec. or less) or more and whether or not the amount of change in the actual opening degree TA is a predetermined value (e.g. 3° or less) or lower. In this case, since the determination on the amount of change in the actual opening degree TA is added to the judging content shown in FIG. 24, it is possible to more reliably obtain substantive motion of the throttle valve 6. In the judging content shown in FIG. 25, the case where the motor current continues at the predetermined value or higher for the predetermined time or more indicates that the motor 7 does not operate for the predetermined time or more even though the motor 7 is controlled so as to operate. Further, the case where the amount of change in the detected actual opening degree TA is a predetermined value or lower indicates that the throttle valve 6 actually hardly moves. The case where the throttle valve 6 actually hardly moves even though the motor 7 is attempting to operate more than needed can therefore be regarded as indicating that the throttle valve 6 is frozen. Thus, the icing of the throttle valve 6 is practically detected. This makes it possible to more reliably detect the presence/absence of the icing formed on the throttle valve 6 irrespective of differences in environmental conditions.

Figure 26:
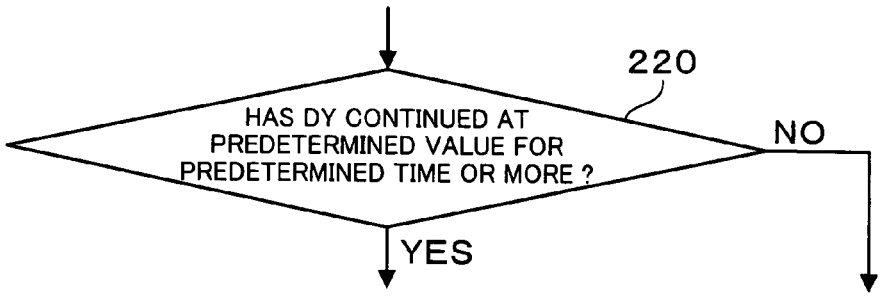
FIG. 26 is a view showing the contents of the closing-side ice-determination.

Further, in the structure that the driving duty DY to be supplied to the motor 7 is controlled to control the output power of the motor 7, as shown in FIG. 26, it may be determined whether or not the driving duty DY has continued at a predetermined value (e.g. 50% or more) or higher for a predetermined time (e.g. 2 sec. or less) or more. Here, the case where driving duty DY continues at the predetermined value or higher for the predetermined time or more indicates that the motor 7 is not operating even though it is supplied with the motor current at the driving duty DY, that is, that the throttle valve 6 is not moving. Similarly in this case, accurately obtaining the substantive motion of the throttle valve 6 makes it possible to determine the presence/absence of the closing-side icing. Here, the case where the driving duty DY continues at the predetermined value or higher for the predetermined time or more indicates that the motor 7 does not operate for the predetermined time or more even though it is controlled so as to operate. The case where the motor 7 is attempting to operate more than necessary, that is, where the throttle valve 6 does not actually move, can be regarded as indicating that the throttle valve 6 is frozen. Thus, the icing of the throttle valve 6 can practically be detected. This makes it possible to more reliably detect the presence/absence of the icing formed on the throttle valve 6 irrespective of differences in environmental conditions.

Figure 27:
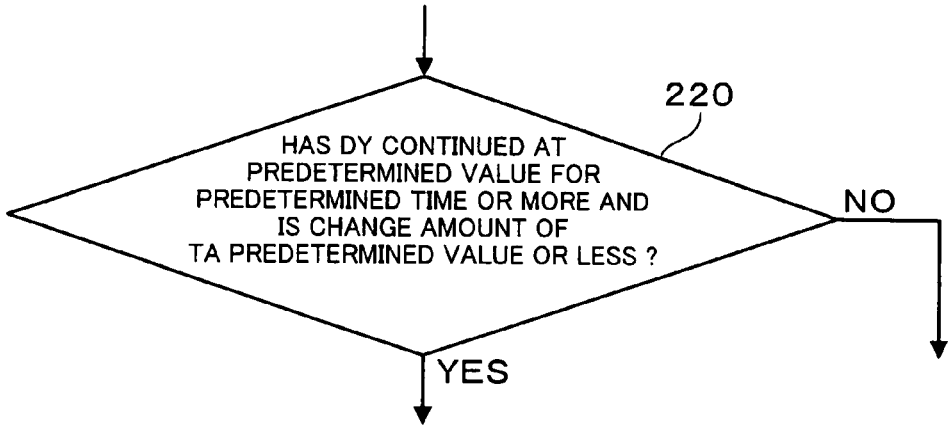
FIG. 27 is a view showing the contents of the closing-side ice-determination.

Further, in the structure that the driving duty DY to be supplied to the motor 7 is controlled to control the output power of the motor 7, as shown in FIG. 27, it may be determined whether or not the driving duty DY has continued at a predetermined value (e.g. 50% or more) or higher for a predetermined time (e.g. 2 sec. or less) or more and whether or not the amount of change in the actual opening degree TA is a predetermined value (e.g. 3° or less) or lower. In this case, since the determination on the amount of change in the actual opening degree TA is added to the judging content shown in FIG. 26, it is possible to more reliably obtain substantive motion of the throttle valve 6. In the judging content shown in FIG. 27, the case where the driving duty DY continues at the predetermined value or higher for the predetermined time or more indicates that the motor 7 does not operate for the predetermined time or more even though it is controlled so as to operate. Further, the case where the amount of change in the detected actual opening degree TA is a predetermined value or lower indicates that the throttle valve 6 actually hardly moves. The case where the throttle valve 6 actually hardly moves even though the motor 7 is attempting to operate more than needed can therefore be regarded as indicating that the throttle valve 6 is frozen. Thus, the icing of the throttle valve 6 is practically detected. This makes it possible to more reliably detect the presence/absence of the icing formed on the throttle valve 6 irrespective of differences in environmental conditions.

Figure 28:
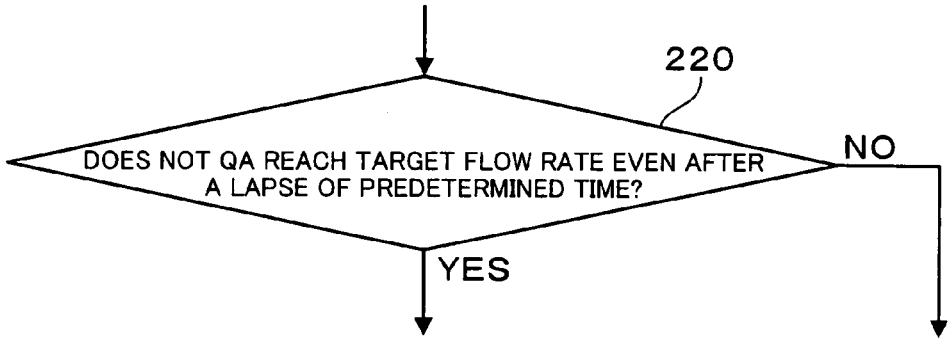
FIG. 28 is a view showing the contents of the closing-side ice-determination.

Moreover, the intake-air flow rate QA detected by the airflow meter 32 may be utilized to make a determination as to whether or not the intake-air flow rate QA does not reach a predetermined target flow rate even after a lapse of a predetermined time (e.g. 5 sec. or less) from the processing start in step 210, as shown in FIG. 28. Here, the case where intake-air flow rate QA does not reach the target flow rate even after the predetermined time has elapsed indicates that the intake-air flow rate QA remains unchanged even though the throttle valve 6 is controlled so as to move, that is, that the throttle valve 6 is not moving. In this case, similarly, accurately obtaining the substantive motion of the throttle valve 6 makes it possible to determine the presence/absence of the closing-side icing. Here, in the judging content shown in FIG. 28, the case where the detected intake-air flow rate QA does not reach the target flow rate even after the driving time for controlling the motor 7 exceeds a predetermined time indicates that the throttle valve 6 does not move even though the motor 7 is controlled to operate for the predetermined time or more and the intake-air flow rate QA does not reach the target flow rate. Accordingly, the case where the throttle valve 6 is not moving in such a way to bring the intake-air flow rate QA to the target flow rate even when the motor 7 is actually controlled can be regarded as indicating that the throttle valve 6 is frozen. Thus, the icing of the throttle valve 6 is practically detected. This can more reliably detect the presence/absence of the icing formed on the throttle valve 6 irrespective of differences in environmental conditions.

In the aforementioned embodiments, in step 220 of FIG. 7, whether the closing-side icing is present is decided based on the judging content shown in FIG. 9. Alternatively, whether the closing-side icing is present may be decided based on appropriate combinations of the judging contents shown in FIGS. 9, and 23 to 28.

For instance, it may be determined on the judging contents incorporating both the judging conditions shown in FIGS. 25 and 26. To be more specific, it may be determined whether or not the motor current has continued at a predetermined value (e.g. 20% or more of the lock current) or higher for a predetermined time (e.g. 2 sec. or less) and the amount of change in the actual opening degree TA is a predetermined value (e.g. 3° or less) or lower and whether or not the driving duty DY has continued at a predetermined value (e.g. 50% or more) or higher for a predetermined time (e.g. 2 sec. or less) or more. In this determination, the case where the throttle valve 6 actually hardly moves or does not actually move even though the motor 7 is controlled so as to operate more than needed is regarded as indicating that the throttle valve 6 is frozen. Thus, the icing of the throttle valve 6 is practically detected. This makes it possible to more reliably detect the presence/absence of the icing formed on the throttle valve 6 irrespective of differences in environmental conditions.

Further, it may be determined on the judging contents incorporating all the judging conditions shown in FIGS. 25, 26 and 9. Specifically, it may be determined whether or not the motor current has continued at predetermined value (e.g. 20% or more of the lock current) or higher for a predetermined time (e.g. 2 sec. or less) and the amount of change in the actual opening degree TA is a predetermined value (e.g. 3° or less) or lower and whether or not the driving duty DY has continued at a predetermined value (e.g. 50% or more) or higher for a predetermined time (e.g. 2 sec. or less) and also whether the actual opening degree TA does not reach the target opening degree RA even after a predetermined time (e.g. 2 sec. or less) has passed from the processing start in step 210. In this determination, the case where the throttle valve 6 actually hardly moves or does not actually move even though the motor 7 is controlled so as to operate more than needed and the throttle valve 6 does not reach the target opening degree RA even though the motor 7 is actually controlled is regarded as indicating that the throttle valve 6 is frozen. Thus, the icing of the throttle valve 6 is practically detected. This makes it possible to more reliably detect the presence/absence of the icing formed on the throttle valve 6 irrespective of differences in environmental conditions.

Further, it may be determined on the judging contents incorporating all the judging conditions shown in FIGS. 25, 26 and 28. Specifically, it may be determined whether or not the motor current has continued at predetermined value (e.g. 20% or more of the lock current) or higher for a predetermined time (e.g. 2 sec. or less) and the amount of change in the actual opening degree TA is a predetermined value (e.g. 3° or less) or lower and whether or not the driving duty DY has continued at a predetermined value (e.g. 50% or more) or higher for a predetermined time (e.g. 2 sec. or less) and also whether the intake-air flow rate QA does not reach the target flow rate even after a predetermined time (e.g. 5 sec. or less) has passed from the processing start in step 210. In this determination, the case where the throttle valve 6 actually hardly moves or does not actually move even though the motor 7 is attempting to operate more than needed and the throttle valve 6 does not move in such a way to bring the intake-air flow rate QA to the target flow rate even though the motor 7 is actually controlled is regarded as indicating that the throttle valve 6 is frozen. Thus, the icing of the throttle valve 6 is practically detected. This makes it possible to more reliably detect the presence/absence of the icing formed on the throttle valve 6 irrespective of differences in environmental conditions.

Further, it may be determined on the judging contents incorporating all the judging conditions shown in FIGS. 25, 26, 9, and 28. Specifically, it may be determined whether or not the motor current has continued at predetermined value (e.g. 20% or more of the lock current) or higher for a predetermined time (e.g. 2 sec. or less) and the amount of change in the actual opening degree TA is a predetermined value (e.g. 3° or less) or lower and whether or not the driving duty DY has continued at a predetermined value (e.g. 50% or more) or higher for a predetermined time (e.g. 2 sec. or less) and also whether the actual opening degree TA does not reach the target opening degree RA even after a predetermined time (e.g. 2 sec. or less) has elapsed from the processing start in step 210 and whether the intake-air flow rate QA does not reach the target flow rate even after a predetermined time (e.g. 5 sec. or less) has elapsed from the processing start in step 210. In this determination, the case where the throttle valve 6 actually hardly moves or does not actually move even though the motor 7 is controlled so as to operate more than needed, the throttle valve 6 does not reach the target opening degree RA even though the motor 7 is actually controlled, and the throttle valve 6 does not move in such a way to bring the intake-air flow rate QA to the target flow rate even though the motor 7 is actually controlled is regarded as indicating that the throttle valve 6 is frozen. Thus, the icing of the throttle valve 6 is practically detected. This makes it possible to more reliably detect the presence/absence of the icing formed on the throttle valve 6 irrespective of differences in environmental conditions.

Besides, it may be determined based on the following combinations of the judging contents shown in FIGS. 9 and 23 to 28.

Specifically, it may be determined on the judging contents incorporating both the judging conditions shown in FIGS. 24 and 26. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

Further, it may be determined on the judging contents incorporating the judging conditions shown in FIGS. 24, 26, and 9. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

Further, it may be determined on the judging contents incorporating the judging conditions shown in FIGS. 24, 26, 9, and 28. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

Further, it may be determined on the judging contents incorporating the judging conditions shown in FIGS. 24 and 9. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

Further, it may be determined on the judging contents incorporating the judging conditions shown in FIGS. 24, 9, and 28. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

Further, it may be determined on the judging contents incorporating the judging conditions shown in FIGS. 24 and 28. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

Further, it may be determined on the judging contents incorporating the judging conditions shown in FIGS. 26 and 9. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

Further, it may be determined on the judging contents incorporating the judging conditions shown in FIGS. 26, 9, and 28. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

Further, it may be determined on the judging contents incorporating the judging conditions shown in FIGS. 26 and 28. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

Further, it may be determined on the judging contents incorporating the judging conditions shown in FIGS. 9 and 28. Alternatively, in addition to those conditions, it may be determined on the judging contents further incorporating the judging condition that the amount of change in operation (for example, actual opening degree TA) detected by an operation detecting device (for example, the throttle sensor 8) which detects the operation (movement) of the throttle valve 6 is a predetermined value or lower.

In the embodiment described above, the ECU 2 is arranged to supply the driving duty DY to cause the motor 7 to produce the required driving torque to eliminate the icing of the throttle valve 6, reverse the driving duty DY by open control, and control the motor 7 to bring the accumulated value of the deviation between the target opening degree RA and the actual opening degree TA of the throttle valve 6 to zero. On the other hand, the ECU 2 may be configured to supply the driving duty DY to cause the motor 7 to output the required driving torque to eliminate the icing of the throttle valve 6, reverse the driving duty DY by open control, and control the motor 7 to bring the accumulated value of the deviation between the target flow rate of the throttle valve 6 and a flow-rate corresponding value calculated by conversion from the detected intake-air flow rate QA or actual opening degree TA to zero. In this case, since the motor 7 is caused to produce the required driving torque to eliminate the icing of the throttle valve 6, the throttle valve 6 can operate at a maximum speed, imparting an effective impact force to break the icing. Further, since the driving duty DY to be supplied to the motor 7 is reversed by open control, the driving torque of the motor 7 increases, causing the throttle valve 6 to operate at a higher operating speed. Moreover, the motor 7 is controlled so that the accumulation of the deviation between the target flow rate of the throttle valve 6 and the flow-rate corresponding value of the detected intake-air flow rate QA or the detected actual opening degree TA reaches zero. Accordingly, the throttle valve 6 can be swung while restraining the amount of change in the intake-air flow rate QA, so that the throttle valve 6 repeatedly impinges the icing, thereby giving it an impact force. This makes it possible to increase the icing elimination force of the throttle valve 6, thus more reliably eliminating the hard icing of the throttle valve 6. It is also possible to restrain the amount of change in the intake-air flow rate QA resulting from the operation of the throttle valve 6, thereby preventing power variation of the engine 3.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A throttle control apparatus for an internal combustion engine comprising:

a throttle valve placeable in an intake passage of the internal combustion engine;

a driving device which drives the throttle valve;

a control device for controlling the driving device; and an icing determination device which determines that the throttle valve is frozen when a driving current that the control device supplies to the driving device to drive the throttle valve has continued at a predetermined value or higher for a predetermined time or more.

2. The throttle control apparatus according to claim 1 further comprising an operation detecting device for detecting operation of the throttle valve, wherein the icing determination device determines that the throttle valve is frozen when the condition that the driving current the control device supplies to the driving device to drive the throttle valve has continued at the predetermined value or higher for the predetermined time or more is satisfied and further a condition that an amount of change in the detected operation is a predetermined value or lower is satisfied.

3. A throttle control apparatus for an internal combustion engine comprising:

a throttle valve placeable in an intake passage of the internal combustion engine;

a driving device which drives the throttle valve;

a control device for controlling the driving device; and an icing determination device which determines that the throttle valve is frozen when a driving duty that the control device supplies to the driving device to drive the throttle valve has continued at a predetermined value or higher for a predetermined time or more.

4. The throttle control apparatus according to claim 3 further comprising an operation detecting device for detecting operation of the throttle valve, wherein the icing determination device determines that the throttle valve is frozen when the condition that the driving duty that the control device supplies to the driving device to drive the throttle valve has continued at the predetermined value or higher for the predetermined time or more is satisfied and further a condition that an amount of change in the detected operation is a predetermined value or lower is satisfied.

5. The throttle control apparatus according to claim 4, wherein the icing determination device determines that the throttle valve is frozen when the condition that the driving duty that the control device supplies to the driving device to driving the throttle valve has continued at the predetermined value or higher for the predetermined time or more and the condition that the amount of change in the detected operation is the predetermined value or lower are satisfied, and further a condition that a driving current that the control device supplies to the driving device to driving the throttle valve has continued at a predetermined value or higher for a predetermined time or more is satisfied.

6. The throttle control apparatus according to claim 4 further comprising an opening-degree detecting device for detecting an opening degree of the throttle valve, wherein the icing determination device determines that the throttle valve is frozen when the condition that the driving duty that the control device supplies to the driving device to driving the throttle valve has continued at the predetermined value or higher for the predetermined time or more, the condition that the amount of change in the detected operation is the predetermined value or lower are satisfied and further a condition that a driving current that the control device supplies to the driving device to drive the throttle valve has continued at a predetermined value or higher for a predetermined time or more and a condition that the detected opening degree does not reach a target opening degree even after a driving time for which the control device controls the driving device to drive the throttle valve has exceeded a predetermined time are satisfied.

7. The throttle control apparatus according to claim 4 further comprising an intake-air flow rate detecting device for detecting an intake-air flow rate in the intake passage, wherein the icing determination device determines that the throttle valve is frozen when the condition that the driving duty that the control device supplies to the driving device to drive the throttle valve has continued at the predetermined value or higher for the predetermined time or more and the condition that the amount of change in the detected operation is the predetermined value or lower are satisfied and further a condition that a driving current that the control device supplies to the driving device to drive the throttle valve has continued at a predetermined value or higher for a predetermined time or more and a condition that the detected intake-air flow rate does not reach a target flow rate even after a driving time for which the control device controls the driving device to drive the throttle valve has exceeded a predetermined time are satisfied.

8. The throttle control apparatus according to claim 4 further comprising an opening-degree detecting device for detecting an opening degree of the throttle valve and an intake-air flow rate detecting device for detecting an intake-air flow rate in the intake passage, wherein the icing determination device determines that the throttle valve is frozen when the condition that the driving duty that the control device supplies to the driving device to drive the throttle valve has continued at the predetermined value or higher for the predetermined time or more and the condition that the amount of change in the detected operation is the predetermined value or lower are satisfied and further a condition that a driving current that the control device supplies to the driving device to driving the throttle valve has continued at a predetermined value or higher for a predetermined time or more and a condition that the detected opening degree does not reach a target opening degree even after a driving time for which the control device controls the driving device to drive the throttle valve has exceeded a predetermined time and a condition that the detected intake-air flow rate does not reach a target flow rate even after the driving time for which the control device controls the driving device to drive the throttle valve has exceeded the predetermined time are satisfied.

9. A throttle control apparatus for an internal combustion engine comprising:

a throttle valve placeable in an intake passage of the internal combustion engine;

a driving device which drives the throttle valve;

a control device for controlling the driving device;

an opening-degree detecting device for detecting an opening degree of the throttle valve; and an icing determination device which determines that the throttle valve is frozen when the detected opening degree does not reach a target opening degree even after a driving time for which the control device controls the driving device to drive the throttle valve has exceeded a predetermined time.

10. The throttle control apparatus according to claim 9, wherein the icing determination device determines that the throttle valve is frozen when the condition that the detected opening degree does not reach the target opening degree even after the driving time for which the control device controls the driving device to drive the throttle valve has exceeded the predetermined time is satisfied and further a condition that an amount of change in the detected opening degree is a predetermined value or lower is satisfied.

11. A throttle control apparatus for an internal combustion engine comprising:

a throttle valve placeable in an intake passage of the internal combustion engine;

a driving device which drives the throttle valve;

a control device for controlling the driving device; and an opening-degree detecting device for detecting an opening degree of the throttle valve, wherein, to eliminate icing of the throttle valve, the control device supplies a driving duty to cause the driving device to produce a required driving torque and reverses the driving duty by open control, and further controls the driving device to bring an accumulated value of a deviation between a target opening degree of the throttle valve and the detected opening degree to zero.

12. The throttle control apparatus according to claim 11 further comprising a fault processing device which determines a fault when one of the number of revolutions of the driving device and the time for driving the driving device has exceeded a predetermined value, and terminates the control of the driving device.

13. The throttle control apparatus according to claim 11 further comprising a prestart icing determination device which determines whether or not the throttle valve is frozen before start of the internal combustion engine.

14. The throttle control apparatus according to claim 11 further comprising a prestart icing determination device which determines whether or not the throttle valve is frozen before start of the internal combustion engine.

15. The throttle control apparatus according to claim 11 further comprising a prestart icing determination device which determines whether or not the throttle valve is frozen before start of the internal combustion engine, wherein the opening-degree storage device stores the detected opening when it is determined that the throttle valve is frozen.

16. The throttle control apparatus according to claim 11 further comprising a prestart icing determination device which determines whether or not the throttle valve is frozen before start of the internal combustion engine, wherein the opening-degree storage device stores the detected opening when it is determined that the throttle valve is frozen, and the control device terminates the control of the driving device for eliminating the icing when a deviation between a target opening degree of the throttle valve and the stored icing opening degree is larger than a predetermined value after the start of the internal combustion engine.

17. The throttle control apparatus according to claim 11 further comprising a after-start icing determination device which determines whether or not the throttle valve is frozen after start of the internal combustion engine, wherein the control device controls the driving device for eliminating the icing after the start of the internal combustion engine when it is determined that the throttle valve is frozen.

18. A throttle control apparatus for an internal combustion engine comprising:

a throttle valve placeable in an intake passage of the internal combustion engine;

a driving device which drives the throttle valve;

a control device for controlling the driving device;

an intake-air flow rate detecting device for detecting one of an intake-air flow rate in the intake passage; and an opening-degree detecting device for detecting an opening degree of the throttle valve, wherein, to eliminate icing of the throttle valve, the control device supplies a driving duty to cause the driving device to produce a required driving torque and reverses the driving duty by open control, and further controls the driving device to bring an accumulated value of a deviation between a target flow rate of the throttle valve and a flow-rate corresponding value calculated by conversion from the one of the detected intake-air flow rate and the detected opening degree to zero.

19. The throttle control apparatus according to claim 18 further comprising a fault processing device which determines a fault when one of the number of revolutions of the driving device and the time for driving the driving device has exceeded a predetermined value, and terminates the control of the driving device.

20. The throttle control apparatus according to claim 18 further comprising a prestart icing determination device which determines whether or not the throttle valve is frozen before start of the internal combustion engine.

21. The throttle control apparatus according to claim 18 further comprising a prestart icing determination device which determines whether or not the throttle valve is frozen before start of the internal combustion engine, wherein the opening-degree storage device stores the detected opening when it is determined that the throttle valve is frozen.

22. The throttle control apparatus according to claim 18 further comprising a prestart icing determination device which determines whether or not the throttle valve is frozen before start of the internal combustion engine, wherein the opening-degree storage device stores the detected opening when it is determined that the throttle valve is frozen, and the control device terminates the control of the driving device for eliminating the icing when a deviation between a target opening degree of the throttle valve and the stored icing opening degree is larger than a predetermined value after the start of the internal combustion engine.

23. The throttle control apparatus according to claim 18 further comprising a after-start icing determination device which determines whether or not the throttle valve is frozen after start of the internal combustion engine, wherein the control device controls the driving device for eliminating the icing after the start of the internal combustion engine when it is determined that the throttle valve is frozen.

24. A throttle control apparatus for an internal combustion engine comprising:

a throttle valve placeable in an intake passage of the internal combustion engine;

a driving device which drives the throttle valve;

a control device for controlling the driving device;

an opening-degree detecting device for detecting an opening degree of the throttle valve; and an opening-degree storage device which stores the opening degree detected when the throttle valve is frozen and updates and stores the detected opening degree when the icing of the throttle valve comes loose, wherein, to eliminate icing of the throttle valve, the control device supplies a driving duty to cause the driving device to produce a required driving torque and reverses the driving duty by open control, and further controls the driving device to bring an accumulated value of a deviation between a target opening degree of the throttle valve and the detected opening degree to zero.

25. The throttle control apparatus according to claim 24, wherein the control device supplies the driving duty to cause the driving device to produce the required driving torque, reverses the driving duty by open control, and controls the driving device to bring the accumulated value of the deviation between the target opening degree of the throttle valve and the detected opening to zero, and further changes a parameter for the control of the driving device according to the deviation between the target opening degree and the opening degree detected when the throttle valve is frozen, to eliminate the icing of the throttle valve.

26. The throttle control apparatus according to claim 25, wherein the control device controls the driving device to eliminate the icing of the throttle valve until the throttle valve moves close to a full closed position.

27. The throttle control apparatus according to claim 25 further comprising a fault processing device which determines a fault when one of the number of revolutions of the driving device and the time for driving the driving device has exceeded a predetermined value, and terminates the control of the driving device.

28. The throttle control apparatus according to claim 25 further comprising a prestart icing determination device which determines whether or not the throttle valve is frozen before start of the internal combustion engine.

29. The throttle control apparatus according to claim 25 further comprising a prestart icing determination device which determines whether or not the throttle valve is frozen before start of the internal combustion engine, wherein the opening-degree storage device stores the detected opening when it is determined that the throttle valve is frozen.

30. The throttle control apparatus according to claim 25 further comprising a prestart icing determination device which determines whether or not the throttle valve is frozen before start of the internal combustion engine, wherein the opening-degree storage device stores the detected opening when it is determined that the throttle valve is frozen, and the control device terminates the control of the driving device for eliminating the icing when a deviation between a target opening degree of the throttle valve and the stored icing opening degree is larger than a predetermined value after the start of the internal combustion engine.

31. The throttle control apparatus according to claim 25 further comprising a after-start icing determination device which determines whether or not the throttle valve is frozen after start of the internal combustion engine, wherein the control device controls the driving device for eliminating the icing after the start of the internal combustion engine when it is determined that the throttle valve is frozen.

32. The throttle control apparatus according to claim 24, wherein the control device controls the driving device to eliminate the icing of the throttle valve until the throttle valve moves close to a full closed position.

33. The throttle control apparatus according to claim 32 further comprising a fault processing device which determines a fault when one of the number of revolutions of the driving device and the time for driving the driving device has exceeded a predetermined value, and terminates the control of the driving device.

34. The throttle control apparatus according to claim 32 further comprising a prestart icing determination device which determines whether or not the throttle valve is frozen before start of the internal combustion engine.

35. The throttle control apparatus according to claim 32 further comprising a prestart icing determination device which determines whether or not the throttle valve is frozen before start of the internal combustion engine, wherein the opening-degree storage device stores the detected opening when it is determined that the throttle valve is frozen.

36. The throttle control apparatus according to claim 32 further comprising a prestart icing determination device which determines whether or not the throttle valve is frozen before start of the internal combustion engine, wherein the opening-degree storage device stores the detected opening when it is determined that the throttle valve is frozen, and the control device terminates the control of the driving device for eliminating the icing when a deviation between a target opening degree of the throttle valve and the stored icing opening degree is larger than a predetermined value after the start of the internal combustion engine.

37. The throttle control apparatus according to claim 32 further comprising a after-start icing determination device which determines whether or not the throttle valve is frozen after start of the internal combustion engine, wherein the control device controls the driving device for eliminating the icing after the start of the internal combustion engine when it is determined that the throttle valve is frozen.

38. The throttle control apparatus according to claim 24 further comprising a fault processing device which determines a fault when one of the number of revolutions of the driving device and the time for driving the driving device has exceeded a predetermined value, and terminates the control of the driving device.

39. The throttle control apparatus according to claim 24 further comprising a prestart icing determination device which determines whether or not the throttle valve is frozen before start of the internal combustion engine.

40. The throttle control apparatus according to claim 24 further comprising a prestart icing determination device which determines whether or not the throttle valve is frozen before start of the internal combustion engine, wherein the opening-degree storage device stores the detected opening when it is determined that the throttle valve is frozen.

41. The throttle control apparatus according to claim 24 further comprising a prestart icing determination device which determines whether or not the throttle valve is frozen before start of the internal combustion engine, wherein the opening-degree storage device stores the detected opening when it is determined that the throttle valve is frozen, and the control device terminates the control of the driving device for eliminating the icing when a deviation between a target opening degree of the throttle valve and the stored icing opening degree is larger than a predetermined value after the start of the internal combustion engine.

42. The throttle control apparatus according to claim 24 further comprising a after-start icing determination device which determines whether or not the throttle valve is frozen after start of the internal combustion engine, wherein the control device controls the driving device for eliminating the icing after the start of the internal combustion engine when it is determined that the throttle valve is frozen.

43. A throttle control apparatus for an internal combustion engine comprising:

a throttle valve placeable in an intake passage of the internal combustion engine;

a driving device which drives the throttle valve;

a control device for controlling the driving device; and a fault processing device which determines a fault when one of a number of revolutions of the driving device and a time for driving the driving device has exceeded a predetermined value, and terminates the control of the driving device, wherein the control device supplies a driving duty to cause the driving device to produce a required torque and reverses the driving duty by open control to eliminate icing of the throttle valve.

44. A throttle control apparatus for an internal combustion engine comprising:

a throttle valve placeable in an intake passage of the internal combustion engine;

a driving device which drives the throttle valve;

a control device for controlling the driving device;

an opening-degree detecting device for detecting an opening degree of the throttle valve;

an opening-degree storage device which stores the opening degree detected when the throttle valve is frozen and updates and stores the detected opening degree when icing of the throttle valve comes loose; and a prestart icing determination device which determines whether or not the throttle valve is frozen before start of the internal combustion engine, wherein the control device supplies a driving duty to cause the driving device to produce a required torque and reverses the driving duty by open control to eliminate icing of the throttle valve, and wherein the opening-degree storage device stores the detected opening degree when the prestart icing determination device determines that the throttle valve is frozen.

45. A throttle control apparatus for an internal combustion engine comprising:

a throttle valve placeable in an intake passage of the internal combustion engine;

a driving device which drives the throttle valve;

a control device for controlling the driving device; and a prestart icing determination device which determines whether or not the throttle valve is frozen before start of the internal combustion engine, wherein the control device supplies a driving duty to cause the driving device to produce a required torque and reverses the driving duty by open control to eliminate icing of the throttle valve, and wherein when the prestart icing determination device determines that the throttle valve is frozen, the control device controls the driving device to drive the throttle valve in an opening direction to eliminate the icing of the throttle valve before the start of the internal combustion engine.

46. The throttle control apparatus according to claim 45, wherein the opening-degree storage device updates and stores the detected opening degree when the icing comes loose during warm-up of the internal combustion engine, and the control device controls the driving device based on the updated and stored opening degree.

47. A throttle control apparatus for an internal combustion engine comprising:

a throttle valve placeable in an intake passage of the internal combustion engine;

a driving device which drives the throttle valve;

a control device for controlling the driving device;

an opening-degree detecting device for detecting an opening degree of the throttle valve;

an opening-degree storage device which stores the opening degree detected when the throttle valve is frozen and updates and stores the detected opening degree when icing of the throttle valve comes loose; and a prestart icing determination device which determines whether or not the throttle valve is frozen before start of the internal combustion engine, wherein the control device supplies a driving duty to cause the driving device to produce a required torque and reverses the driving duty by open control to eliminate icing of the throttle valve, and wherein the opening-degree storage device updates and stores the detected opening degree when the icing comes loose during warm-up of the internal combustion engine, and the control device controls the driving device based on the updated and stored opening degree.

48. A throttle control apparatus for an internal combustion engine comprising:

a throttle valve placeable in an intake passage of the internal combustion engine;

a driving device which drives the throttle valve;

a control device for controlling the driving device;

an opening-degree detecting device for detecting an opening degree of the throttle valve;

an opening-degree storage device which stores the opening degree detected when the throttle valve is frozen and updates and stores the detected opening degree when icing of the throttle valve comes loose; and a prestart icing determination device which determines whether or not the throttle valve is frozen before start of the internal combustion engine, wherein the control device supplies a driving duty to cause the driving device to produce a required torque and reverses the driving duty by open control to eliminate icing of the throttle valve, and wherein the opening-degree storage device stores the detected opening when the prestart icing determination device determines that the throttle valve is frozen, and the control device terminates the control of the driving device for eliminating the icing when a deviation between a target opening degree of the throttle valve and the stored icing opening degree is larger than a predetermined value after the start of the internal combustion engine.

49. A throttle control apparatus for an internal combustion engine comprising:

a throttle valve placeable in an intake passage of the internal combustion engine;

a driving device which drives the throttle valve;

a control device for controlling the driving device; and a after-start icing determination device which determines whether or not the throttle valve is frozen after start of the internal combustion engine, wherein the control device supplies a driving duty to cause the driving device to produce a required torque and reverses the driving duty by open control to eliminate icing of the throttle valve, and wherein the control device controls the driving device for eliminating the icing after the start of the internal combustion engine when it is determined that the throttle valve is frozen.

* * * * *